US011007523B2

(12) United States Patent
Li et al.

(10) Patent No.: US 11,007,523 B2
(45) Date of Patent: May 18, 2021

(54) INJECTION MOLDED MICROFLUIDIC/FLUIDIC CARTRIDGE INTEGRATED WITH SILICON-BASED SENSOR

(71) Applicant: MGI Tech Co., Ltd., Shenzhen (CN)

(72) Inventors: Chen Li, San Jose, CA (US); Cheng Frank Zhong, Menlo Park, CA (US); Yu Liu, San Jose, CA (US); Yiwen Ouyang, San Jose, CA (US)

(73) Assignee: MGI TECH CO., LTD., Shenzen (CN)

( * ) Notice: Subject to any disclaimer, the term of this patent is extended or adjusted under 35 U.S.C. 154(b) by 171 days.

(21) Appl. No.: 16/119,450

(22) Filed: Aug. 31, 2018

(65) Prior Publication Data

US 2019/0070606 A1 Mar. 7, 2019

Related U.S. Application Data

(60) Provisional application No. 62/553,614, filed on Sep. 1, 2017.

(51) Int. Cl.
*B01L 3/00* (2006.01)

(52) U.S. Cl.
CPC ... *B01L 3/502715* (2013.01); *B01L 3/502738* (2013.01); *B01L 2200/027* (2013.01);
(Continued)

(58) Field of Classification Search
CPC ..... B01L 3/502715; B01L 3/502738; B01L 3/5027; B01L 3/502; B01L 3/50;
(Continued)

(56) References Cited

U.S. PATENT DOCUMENTS

2005/0092662 A1 5/2005 Gilbert et al.
2012/0316086 A1 12/2012 Lin et al.
(Continued)

FOREIGN PATENT DOCUMENTS

WO 2008/060415 A1 5/2008
WO 2013/188582 A1 12/2013
WO 2017/030999 A1 2/2017

OTHER PUBLICATIONS

Drmanac, R. et al. "Human Genome Sequencing Using Unchained Base Reads on Self-Assembling DNA Nanoarrays," *Science*, vol. 327, No. 78. Published Jan. 2010. pp. 78-81.
(Continued)

*Primary Examiner* — Christine T Mui
(74) *Attorney, Agent, or Firm* — Kilpatrick Townsend & Stockton LLP

(57) ABSTRACT

A microfluidic device includes a substrate, a sensor, and one or more lamination films. The top surface of the substrate can include first recessed grooves forming first open channels and the bottom surface of the plastic substrate can include a first recessed cavity and second recessed groves forming second open channels. A first lamination film can be adhered with the top surface of the plastic substrate to form first closed channels. A second lamination film can be adhered to the bottom surface of the plastic substrate to form second closed channels. The sensor can be on the bottom surface of the substrate such that it overlies the first recessed cavity to form a flow cell with the sensor top surface inward facing. A first closed channel can be fluidically connected with a second closed channel and a first or second closed channel can be fluidically connected with the flow cell.

25 Claims, 14 Drawing Sheets

(52) U.S. Cl.
CPC ..... *B01L 2200/0689* (2013.01); *B01L 2300/0663* (2013.01); *B01L 2300/0887* (2013.01); *B01L 2300/123* (2013.01); *B01L 2400/027* (2013.01); *B01L 2400/06* (2013.01)

(58) Field of Classification Search
CPC ..... B01L 2200/027; B01L 2200/026; B01L 2200/02; B01L 2300/0663; B01L 2300/0627; B01L 2300/06
USPC ..... 422/502, 500, 50
See application file for complete search history.

(56) References Cited

U.S. PATENT DOCUMENTS

| | | | | |
|---|---|---|---|---|
| 2013/0116128 | A1* | 5/2013 | Shen ..... | C12Q 1/6874 506/2 |
| 2015/0266022 | A1* | 9/2015 | Eltoukhy ..... | B01L 7/52 506/13 |
| 2017/0016060 | A1 | 1/2017 | Sabonuchi et al. | |

OTHER PUBLICATIONS

International Search Report and Written Opinion received in International Patent Application No. PCT/US2018/049039, dated Nov. 29, 2018. 14 pages.

Shendure, J. et al. "Next-Generation DNA Sequencing." *Nature Biotechnology*, vol. 26, No. 10. Published Oct. 2008. pp. 1135-1145.

* cited by examiner

INJECTION MOLDED MICROFLUIDIC/FLUIDIC CARTRIDGE INTEGRATED WITH SILICON-BASED SENSOR

CROSS REFERENCE TO RELATED APPLICATIONS

The present application claims the benefit of U.S. Provisional Application No. 62/553,614 filed Sep. 1, 2017 and entitled "AN INJECTION MOLDED MICROFLUIDIC/FLUIDIC CARTRIDGE INTEGRATED WITH SILICON-BASED SENSOR," which is hereby incorporated by reference in its entirety.

BACKGROUND OF THE INVENTION

Certain aspects of the present disclosure relate generally to microfluidic devices and methods, and in particular, encompass microfluidic techniques that integrate sensor and valve control technologies.

BRIEF SUMMARY OF THE INVENTION

Exemplary microfluidic device include a substrate, a sensor, and one or more lamination films. The top surface of the substrate can include first recessed grooves forming first open channels and the bottom surface of the plastic substrate can include a first recessed cavity and second recessed groves forming second open channels. A first lamination film can be adhered with the top surface of the plastic substrate to form first closed channels. A second lamination film can be adhered to the bottom surface of the plastic substrate to form second closed channels. The sensor can be on the bottom surface of the substrate such that it overlies the first recessed cavity to form a flow cell with the sensor top surface (capable of receiving signal) inward facing. A first closed channel can be fluidically connected with a second closed channel and a first or second closed channel can be fluidically connected with the flow cell.

In one aspect embodiments of the present disclosure encompass microfluidic devices that include a plastic substrate having a first surface and a second surface, where the first and second surfaces are disposed on opposite sides of the plastic substrate. A microfluidic device can also include a sensor having a first surface and a second surface, where the first surface has an electronic circuit layer. A microfluidic device can further include a lamination film. The first surface of the plastic substrate can have an input recessed groove and an output recessed groove. The second surface of the plastic substrate can have a recessed cavity. The lamination film can be adhered to the first surface of the plastic substrate and can cover the input recessed groove and the output recessed groove, such that an input closed channel is formed by the lamination film and the input recessed groove and an output closed channel is formed by the lamination film and the output recessed groove. The sensor can cover the recessed cavity, such that a flow cell is formed by the first surface of the sensor and the recessed cavity. The input closed channel can be fluidly connected with the flow cell, and the output closed channel can be fluidly connected with the flow cell. In some cases, a device can include an elastomer spacer disposed in the recessed cavity between the substrate and the sensor, such that the flow cell is formed by the first surface of the sensor, the recessed cavity, and the elastomer spacer. In some cases, an elastomer spacer can provide space between the first surface of the sensor and the second surface of the substrate. The depth of the flow cell can be defined by the thickness of the elastomer spacer after assembling.

In another aspect, a microfluidic device can further include a second lamination film. A second surface of the plastic substrate can have a second input recessed groove and a second output recessed groove. The second lamination film can be adhered to the second surface of the plastic substrate and can cover the input recessed groove and the output recessed groove, such that a second input closed channel is formed by the second lamination film and the second input recessed groove and a second output closed channel is formed by the second lamination film and the second output recessed groove. The input closed channel can be fluidly connected with the second input closed channel and the output closed channel can be fluidly connected with the second output closed channel, such that the input closed channel provides fluid communication between the second input closed channel and the flow cell and the output closed channel provides fluid communication between the second output closed channel and the flow cell. In some cases, the input closed channel is fluidly connected with the second input closed channel by an input via positioned within the plastic substrate and the output closed channel is fluidly connected with the second output closed channel by an output via positioned within the plastic substrate. In some cases, the plastic substrate includes an injection molded plastic. In some cases, the plastic substrate is optically transparent. In some cases, a microfluidic device can further include a printed circuit board coupled with the second surface of the sensor. In some cases, a microfluidic device can further include a wire bond, where the second surface of the plastic substrate further includes a recess that receives the wire bond.

In another aspect, a microfluidic device can further include a valve assembly that controls flow through the input closed channel and the output closed channel. The valve assembly can include a manifold having an input control aperture and an output control aperture, an elastomeric sheet disposed between the manifold and the upper surface of the plastic substrate, and a raised structure extending from the upper surface of the plastic substrate toward the elastomeric sheet. The raised structure can have an input proximal ridge, an input distal ridge, an input stem positioned between the input proximal ridge and the input distal ridge, an output proximal ridge, an output distal ridge, and an output stem positioned between the output proximal ridge and the output distal ridge. The elastomeric sheet can be compressed by the manifold against the input proximal and distal ridges and the output proximal and distal ridges, thereby forming an input proximal channel between the input proximal ridge and the input stem, an input distal channel between the input stem and the input distal ridge, an output proximal channel between the output proximal ridge and the output stem, and an output distal channel between the output stem and the output distal ridge. In some cases, the input stem is aligned with the input control aperture and the output stem is aligned with the output control aperture. In some cases, the elastomeric sheet contacts the input and output stems when the elastomeric sheet is in a default sealing configuration, thereby preventing fluid communication between the input distal channel and the input proximal channel and between the output distal channel and the output proximal channel. In some cases, the contact sheet is separated from the input stem when a negative pressure is present in the input control aperture, thereby allowing fluid communication between the input distal channel and the input proximal channel. In some cases, the contact sheets is separated from the output stem when a negative pressure is present in the output control aperture, thereby allowing fluid communication between the output distal channel and the output proximal channel.

In a still further aspect, embodiments of the present disclosure encompass valve assemblies for microfluidic devices. An exemplary valve assembly includes a raise structure, a manifold, and an elastomeric sheet. The raised structure can have a floor, a proximal ridge extending from the floor, a distal ridge extending from the floor, and a stem extending from the floor. The stem can be positioned between the proximal ridge and the distal ridge. The manifold can have a control aperture. The elastomeric sheet can be disposed between the raised structure and the manifold. The elastomeric sheet can be compressed by the manifold against the proximal and distal ridges, thereby forming a proximal channel between the proximal ridge and the stem, and a distal channel between the stem and the distal ridge. The input stem can be aligned with the input control aperture. The elastomeric sheet can contact the stem when the elastomeric sheet is in a sealing configuration, thereby preventing fluid communication between the distal channel and the proximal channel. The elastomeric sheet can be separated from the stem when a negative pressure is present in the control aperture, thereby allowing fluid communication between the distal channel and the proximal channel. In some cases, a valve assembly can further include a pressure source in fluid communication with the control aperture. In some cases, the pressure source can be a positive pressure source. In some cases, a valve assembly can further include a bolt, the manifold can have an aperture that receives the bolt, and the bolt can operate to compress the elastomeric sheet between the manifold and the proximal and distal ridges. In some cases, a valve assembly can further include a snap clamp, and the snap clamp can operate to compress the elastomeric sheet between the manifold and the proximal and distal ridges. In some cases, the distal channel is in fluid communication with a channel of the microfluidic device.

In another aspect, embodiments of the present disclosure encompass methods of flowing a sample through a microfluidic device. An exemplary method can include flowing the sample to an input closed channel of the microfluidic device, flowing the sample from the input closed channel to a flow cell of the microfluidic device, and flowing the sample from the flow cell to an output closed channel of the microfluidic device. In some cases, the input closed channel is formed by a lamination film and an input recessed groove of a plastic substrate. In some cases, the flow cell is formed by a sensor and a recessed cavity of the plastic substrate. In some cases, the output closed channel is formed by the lamination film and an output recessed groove of the plastic substrate. In some cases, the input recessed groove and the output recessed groove are disposed at a first surface of the plastic substrate. In some cases, the recessed cavity is disposed at a second surface of the plastic substrate, where the first and second surfaces are disposed on opposing sides of the plastic substrate. In some cases, the sensor includes an electronic circuit layer, and the electronic circuit layer faces toward an interior of the flow cell.

In yet another aspect, embodiments of the present disclosure encompass methods of controlling sample flow in a microfluidic device. An exemplary method includes flowing a sample into a proximal channel of the microfluidic device, preventing flow of the sample from the proximal channel to a distal channel with a valve in a sealed configuration, and allowing flow of the sample from the proximal channel to the distal channel with the valve in an open configuration. The proximal channel can be formed between a proximal ridge and a stem. The proximal ridge and the stem can extend from a floor of a raised structure. In some cases, the sealed configuration is defined by an elastomeric sheet in contact with the stem, the distal channel is formed between a distal ridge and the stem, the distal ridge extends from a floor of a raised structure, the elastomeric sheet is disposed between a manifold and a raised structure, and the raised structure includes the floor, the proximal ridge, the distal ridge, and the stem. In some cases, the open configuration is defined by the elastomeric sheet being separated from the stem. In some instances, the manifold includes a control aperture aligned with the stem, and the open configuration is achieved by applying a negative pressure to the control aperture.

In a related aspect the invention is directed to methods of nucleic acid sequencing using microfluidic devices described herein. In one approach a surface of the sensor comprises an array of discrete DNA binding regions, and each of a plurality of the binding regions comprise a clonal population of a target DNA disposed thereon. The DNA binding regions are positions so that signal (e.g., fluorescence or luminescence) emitted from a target DNA is detected by the sensor. In an exemplary method, target DNAs are flowed through an input channel of the microfluidic device to a flow cell comprising the sensor, are bound at the DNA binding regions and optionally are amplified. Sequencing of the target DNA sequences occurs through multiple cycles, each cycle involving flowing sequencing reagents from the input channel into the flow cell, detecting a signal resulting from an interaction of the sequencing reagents and the target DNAs, and flowing reaction and waste products out of the flow cell through the output channel.

This Summary is provided to introduce a selection of concepts in a simplified form that are further described below in the Detailed Description. This Summary is not intended to identify key or essential features of the claimed subject matter, nor is it intended to be used to limit the scope of the claimed subject matter. Other features, details, utilities, and advantages of the claimed subject matter will be apparent from the following written Detailed Description including those aspects illustrated in the accompanying drawings and defined in the appended claims.

DETAILED DESCRIPTION OF THE INVENTION

Figure 1:
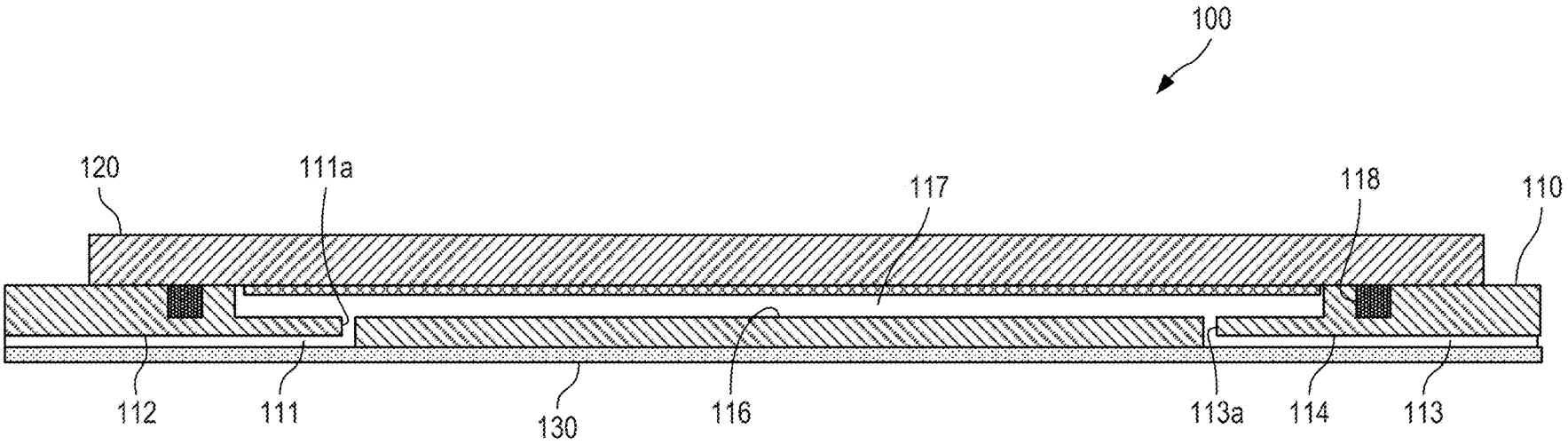
FIG. 1 is a cross-sectional view depicting aspects of an injection molded microfluidic cartridge integrated with a silicon-based sensor according to certain aspects of the present disclosure.

Certain aspects of the present disclosure relate to a microfluidic device having an integrated sensor. The microfluidic device can include a substrate, a sensor, and one or more lamination films. The top surface of the substrate can include first recessed grooves forming first open channels and the bottom surface of the plastic substrate can include a first recessed cavity and second recessed groves forming second open channels. A first lamination film can be adhered with the top surface of the plastic substrate to form first closed channels. A second lamination film can be adhered to the bottom surface of the plastic substrate to form second closed channels. The sensor can be on the bottom surface of the substrate such that it overlies the first recessed cavity to form a flow cell with the sensor top surface inward facing. A first closed channel can be fluidically connected with a second closed channel and a first or second closed channel can be fluidically connected with the flow cell. In some cases, other arrangements can be used.

Certain aspects of the present disclosure relate to arrangements for sealing the interface between the substrate and the sensor to achieve a closed flow cell. In some cases, the interface between the substrate and the sensor can be sealed by a glue or adhesive. In some cases, an over-molded elastomer can be used to seal the interface between the substrate and the sensor. The over-molded elastomer can be over-molded onto the substrate during fabrication. The over-molded elastomer can be compressed against the sensor during use (e.g., using an external clamping mechanism) or can be coupled to the sensor (e.g., using a chemical or physical treatment).

In some cases, the use of a flexible lamination film to form channels of the microfluidic device can further be used to form membrane valves for controlling fluid flow through the microfluidic device. The lamination film can act as a flexible membrane over a valve region in which a portion of two or more channels may be located. A valve seat can be located within the valve region. When the flexible membrane is separated from the valve seat, this separation can form a passage for fluid flow between the channels. When the flexible membrane is compressed against the valve seat, the flexible membrane can act as a fluid barrier, halting or reducing fluid flow between the channels. In some cases, a flexible membrane can be manufactured with a convex shape over the valve region to ensure a normally-open valve that can be closed by applying external force to compress the flexible membrane against the valve seat.

In some cases, a set of secondary channels can each supply different reagents to a common channel, such as to perform different assays in a single flow cell or to provide different combinations of reagents to a single flow cell. Each secondary channel can be coupled to the common channel by a membrane valve, thus permitting easy control over which secondary channel or combination of secondary channels is fluidically coupled to the common channel at any given time.

Fluid driving pressure can be applied to convey fluid through the microfluidic device. Such fluid driving pressure can be positive pressure or negative pressure. Examples of positive pressure generators can include pumps (e.g., liquid pump, pneumatic pump), gravity-fed devices, or other such devices. Examples of negative pressure generators can include vacuums, pumps, or other such devices.

The flow cell can be bounded at least in part by the sensor. In some cases, the flow cell can rest entirely within the boundary of the sensor. In some cases, the flow cell can extend beyond the boundary of the sensor, which can help maximize the available sensor surface area usable to detect data. In some cases, the flow cell can be bounded at least in part by two or more sensors. In such cases, the additional sensors can provide more resolution, can provide more throughput, can enable different types of assays, and/or can permit the use of smaller, cheaper sensors to achieve the same result. In some cases, the ability to use multiple sensors in a flow cell can be inherent to the design of the substrate, with only changes to the printed circuit board necessary to achieve different numbers of sensors. Thus, manufacturing of different types of microfluidic devices (e.g., single-sensor, multi-sensor, high-resolution) can be achieved using the same substrate and different printed circuit boards.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a cross-sectional view depicting aspects of an injection molded microfluidic cartridge integrated with a silicon-based sensor according to certain aspects of the present disclosure. As shown in this sectional view, a microfluidic device 100 includes a substrate 110, a sensor 120, and a lamination film 130. In some cases, a lamination film can include a material such as cyclo olefin polymer (COP), polymethyl methacrylate (PMMA), polycarbonate (PC), polypropylene (PP), cyclic olefin copolymer (COC) and the like. In some cases, a lamination method can be performed by thermal lamination by providing heat to a certain temperature (usually above the glass transition point of the lamination material chosen). In some cases, a lamination method can be performed by solvent assisted thermal bonding. In some cases, a lamination method can be performed by bonding by pressure sensitive adhesive. In some cases, the substrate 110 is a plastic substrate, although other materials can be used. In some cases, the plastic substrate is injection molded. The sensor 120 can be a silicon sensor. In some cases, the sensor 120 can be a high-speed silicon based sensor. In some cases, the sensor 120 can include an integrated circuit (IC) chip. A lower portion of the sensor 120 can be apposed with an upper portion of the substrate 110.

As depicted in FIG. 1, the substrate 110 can have a first recessed groove 112 (e.g. an input groove) and a second recessed groove 114 (e.g. an output groove). The lamination film 130 can be adhered to the lower surface of the substrate 110 and can cover the first recessed groove 112 and the second recessed groove 114, such that a first closed channel 111 is formed by the lamination film 130 and the first recessed groove 112 and a second closed channel 113 is formed by the lamination film 130 and the second recessed groove 114. In some cases, the closed channels are microfluidic channels. In some cases, the feature size of the microfluidic channels can be in the range of tens to hundreds of microns in depth and width. In some cases, a microfluidic channel has a width within a range from 20 μm to 500 μm. In some cases, a microfluidic channel has a depth within a range from 20 μm to 500 μm.

The upper surface of the substrate 110 includes a recessed cavity 116, and the sensor 120 can cover the recessed cavity 116, such that a flow cell 117 is formed at least in part by the lower surface of the sensor 120 and the recessed cavity 116. According to some embodiments, a silicon based sensor can be bonded with a substrate at a cavity to form an enclosed chamber. The lower surface of the sensor 120 can include an electronic circuit layer. As shown here, the first closed channel 111 and the second closed channel 113 can each be fluidly connected with the flow cell 117. For example, first closed channel 111 can be in fluid communication with flow cell 117 via an aperture 111*a* traversing through substrate 110. Similarly, second closed channel 113 can be in fluid communication with flow cell 117 via an aperture 113*a* traversing through substrate 110. In some cases, the width of the flow cell 117 can be in the range of one to ten millimeters. In some cases, the width of the flow cell 117 can be in the range of one to ten centimeters. In some cases, the depth of the flow cell 117 can be in the range of tens to hundreds of microns.

As shown here, apertures 111*a* and 113*a* are used to connect microfluidic channels 111 and 113 on one side of the substrate 110 with the flow cell 117 on the other side of the substrate 110. As discussed elsewhere herein, one or more apertures can be used to connect one or more channels on one side of the substrate with one or more channels on the other side of the substrate. In some cases, the diameter of the apertures can be in the range of hundreds of microns to one to ten millimeters.

According to some embodiments, the microfluidic channels 111, 113 and/or apertures 111*a*, 113*a* can be sealed using a plastic film by thermal lamination, a pressure sensitive adhesive, laser welding, or ultrasonic welding. In some cases, the thickness of the lamination film 130 can be in the range of tens and hundreds of microns.

In some embodiments, first closed channel 111 is an input channel, and second closed channel 113 is an output channel, such that the device 100 provides a flow path that travels from channel 111 to aperture 111*a*, from aperture 111*a* to flow cell 117, from flow cell 117 to aperture 113*a*, and from aperture 113*a* to channel 113. Substrate 110 can also include one or more grooves 118, where glue can be introduced so as to adhere the sensor 120 with the substrate 110. In some cases, the glue can be an epoxy glue. Because the glue can be contained within groove 118, the glue does not leak into the flow path (e.g. into the flow cell or into a closed channel), and hence does not contaminate the sensor (e.g. the surface of the sensor facing toward the interior of the flow cell 117).

It will be recognized that in some embodiments an input channel is fluidically connected to one or more reservoirs containing reagents that can be transported into the flow cell. As used herein, the term "flow cell" refers to the chamber formed by the first recessed cavity and the sensor top surface. "Flow cell" refers to the fact that reagents flow into the chamber or cell, flow over the array of clonal DNA populations in the chamber, and flow out of the chamber. Examples of reagents used in DNA sequencing methods are discussed below. The output channel may be fluidically connected to one or more reservoirs for receiving reagents (e.g., waste) transported out of the flow cell.

According to some embodiments, the microfluidic device 100 can operate in a manner whereby sensor data transfer speeds are not compromised. According to some embodiments, the attachment process does not operate to interfere with an electric connection between a sensor and a printed circuit board (PCB).

According to some embodiments, the microfluidic device 100 can operate in a manner whereby fluids in the microfluidic channels are not disturbed. According to some embodiments, the flow in the device is laminar flow. In some cases, a dead corner where there is no fluid exchange is minimized.

As used herein, the terms "top" and "bottom" are used for illustrative purposes, but do not necessarily relate to any orientation with respect to gravity. Further, while channels or grooves may be described as being in a top or bottom surface or a first or second surface, these channels or grooves may be incorporated into the opposite surface as necessary, such as with the appropriate use of vias, thruways, or apertures.

Figure 2A:
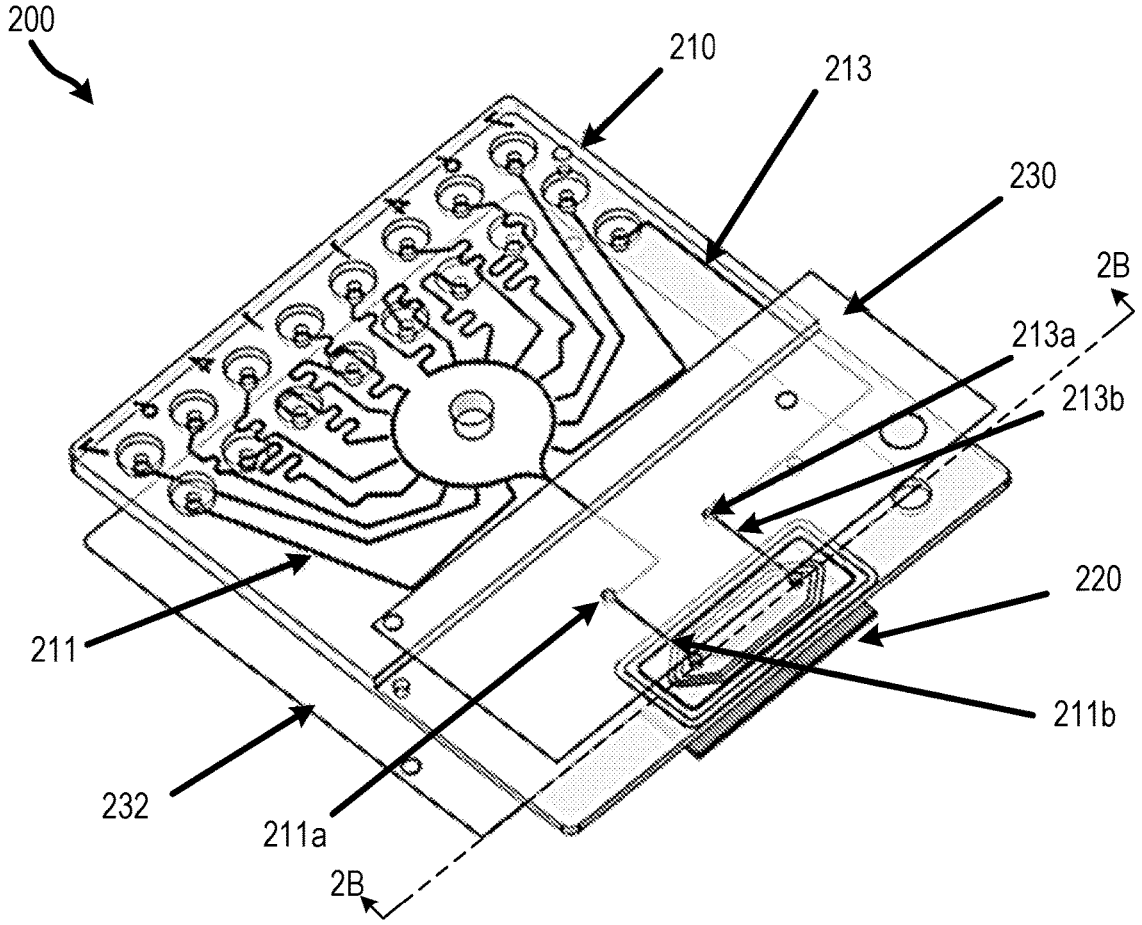
FIG. 2A is an exploded axonometric view depicting aspects of a microfluidic device according to certain aspects of the present disclosure.
Figure 2B:
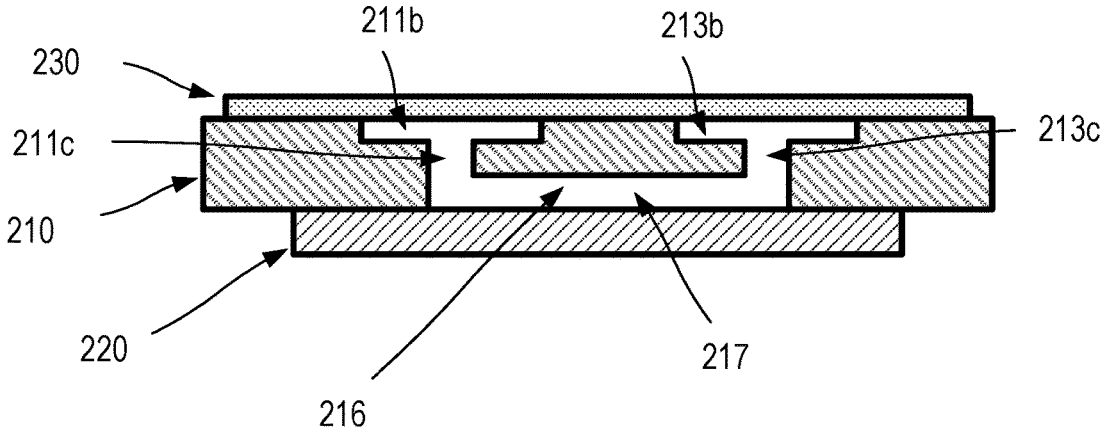
FIG. 2B is a cross-sectional view depicting aspects of the microfluidic device of FIG. 2A taken along line 2B.

FIG. 2A is an exploded axonometric view depicting aspects of a microfluidic device 200 according to certain aspects of the present disclosure. FIG. 2B is a cross-sectional view depicting aspects of the microfluidic device of FIG. 2A taken along line 2B. As shown in the three dimensional exploded view of FIG. 2A, device 200 includes a substrate 210, which can be n injection molded cartridge. As further described below, substrate 210 can be an injection molded plastic piece, and can include microfluidic channels on both sides (i.e., on the upper surface and lower surface) and a flow cell on one of the sides (e.g., the lower surface). Device also includes sensor 220, a first (e.g. upper) lamination film 230, and a second (e.g. lower) lamination film 232. The substrate 210 includes one or more grooves on the lower side of the substrate that, when covered by second lamination film 232, form one or more respective channels (e.g. first lower closed channel 211 and second lower closed channel 213). An upper portion of the sensor 120 can be apposed with a lower portion of the substrate 110.

Similarly, the substrate 210 includes one or more grooves on the upper side of the substrate that, when covered by first lamination film 230, form one or more respective channels (e.g. first upper closed channel 211*b* and second upper closed channel 213*b*). As shown here, first lower closed channel 211 can be in fluid communication with first upper closed channel 211*b* via an aperture 211*a* traversing the substrate 210, and second lower closed channel 213 can be in fluid communication with second upper closed channel 213*b* via an aperture 213*a* traversing the substrate.

The lower surface of the substrate 210 includes a recessed cavity 216, and the sensor 220 can cover the recessed cavity 216, such that a flow cell 217 is formed by the upper surface of the sensor 220 and the recessed cavity 216. First upper closed channel 211*b* can be in fluid communication with flow cell 217 via an aperture 211*c* that passes through the substrate 210 and second upper closed channel 213*b* can be in fluid communication with flow cell 217 via an aperture 213*c* that passes through the substrate 210. In some cases, a surface electrode structure of an IC chip (or a similar detection mechanism of a sensor 220) faces toward the interior of the flow cell.

Hence, device 200 can provide a flow path that travels from first lower closed channel 211 to aperture 211*a*, from aperture 211*a* to first upper closed channel 211*b*, from first upper closed channel 211*b* to aperture 211*c*, from aperture 211*c* to flow cell 217, from flow cell 217 to aperture 213*c*, from aperture 213*c* to second upper closed channel 213*b*, from second upper closed channel 213*b* to aperture 213*a*, and from aperture 213*a* to second lower closed channel 213.

Figure 3:
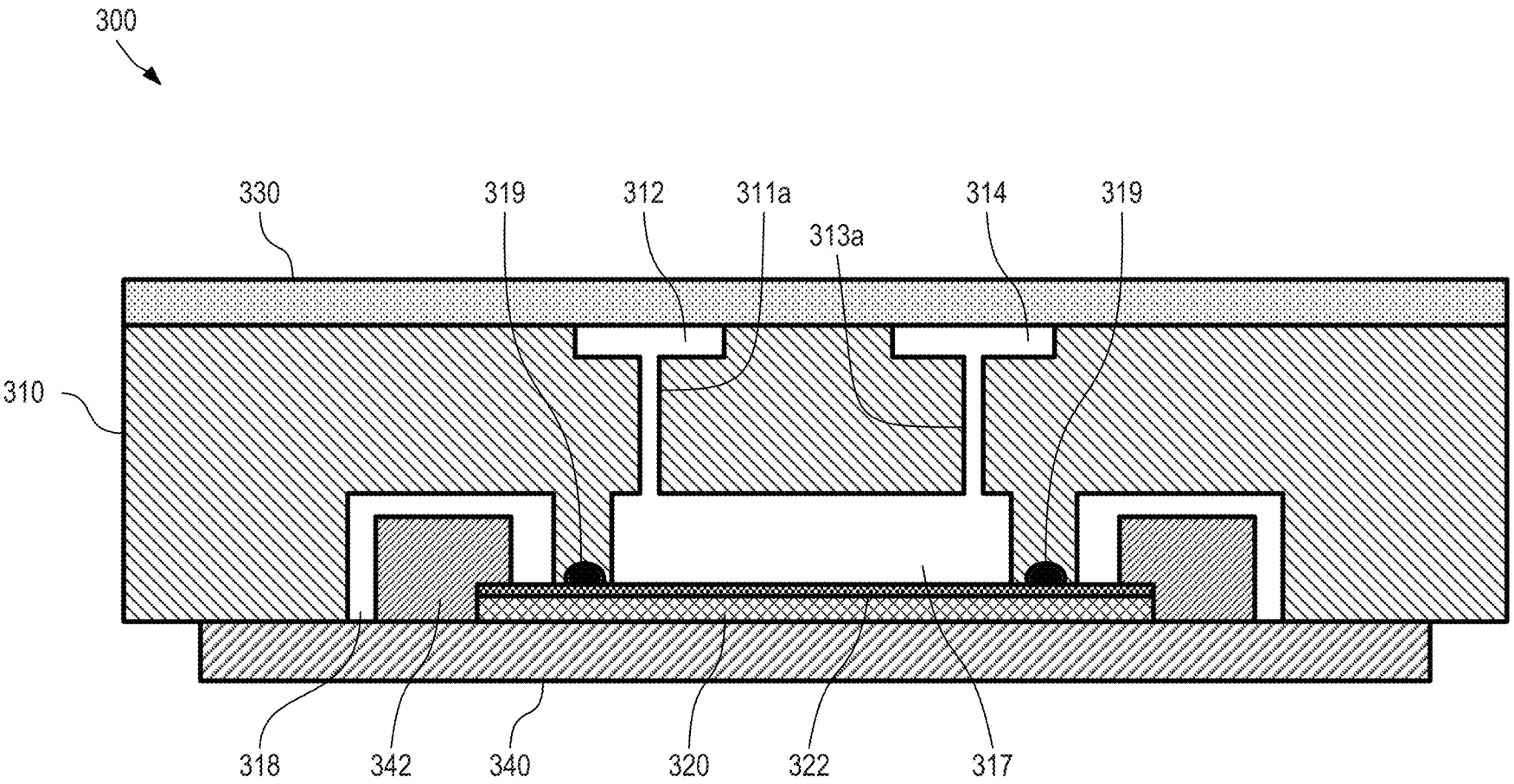
FIG. 3 is a cross-sectional view depicting aspects of a microfluidic device according to certain aspects of the present disclosure.

FIG. 3 is a cross-sectional view depicting aspects of a microfluidic device 300 according to certain aspects of the present disclosure. As shown here, device 300 includes a substrate 310, which can be an injection molded cartridge. Device also includes sensor 320, and a lamination film 330. An upper portion of the sensor 320 can be apposed with a lower portion of the substrate 310.

As depicted in FIG. 3, the substrate 310 can have a first recessed groove 312 (e.g. an input groove) and a second recessed groove 314 (e.g. an output groove). The lamination film 330 can be adhered to the upper surface of the substrate 310 and can cover the first recessed groove 312 and the second recessed groove 314, such that a first closed channel is formed by the lamination film 330 and the first recessed groove 312 and a second closed channel is formed by the lamination film 330 and the second recessed groove 314.

The lower surface of the substrate 310 includes a recessed cavity, and the sensor 320 can cover the recessed cavity, such that a flow cell 317 is formed by the upper surface of the sensor 320 and the recessed cavity. As shown here, an upper surface or portion of the sensor 320 can include a detection mechanism 322 such as an integrated circuit (IC) chip or electronic circuit layer that faces inward toward the interior of the flow cell 317. In some cases, the sensor 320 is configured to detect signals. In some cases, the sensor 320 is configured to detect visible light (e.g., fluorescence or luminescence, such as chemiluminescence). In some cases, the sensor is a complementary metal-oxide-semiconductor (CMOS) sensor. The first upper closed channel can be in fluid communication with the flow cell 317 via an aperture 311*a* that passes through the substrate 310 and second upper closed channel can be in fluid communication with the flow cell 317 via an aperture 313*a* that passes through the substrate 310. As shown here, the flow cell 317 can be sealed by gluing a silicon-based sensor 320 to the microfluidic cartridge substrate 310 using glue or adhesive 319. The injection molded plastic piece or substrate 310 can include grooves that receive the glue, whereby such grooves function to prevent the glue or adhesive from spilling into the flow cell 317, which could contaminate the live sensor area during the gluing process. According to some embodiments, the grooves have feature sizes of dimensions similar to those described elsewhere herein with regard to the microfluidic channels.

A printed circuit board (PCB) 340 can be coupled with the substrate 310 and/or the sensor 320. For example, as depicted here, sensor 320 can be wire bonded (e.g. with one or more wire bonds 342) with the PCB 340 to provide an electronic connection there between. The substrate 310 can include a recess 318 that receives or houses the wire bond 342. This feature can operate to help protect the wire bond 342 from damage during assembly of the microfluidic cartridge substrate 310 and the silicon-based sensor 320.

Figure 4:
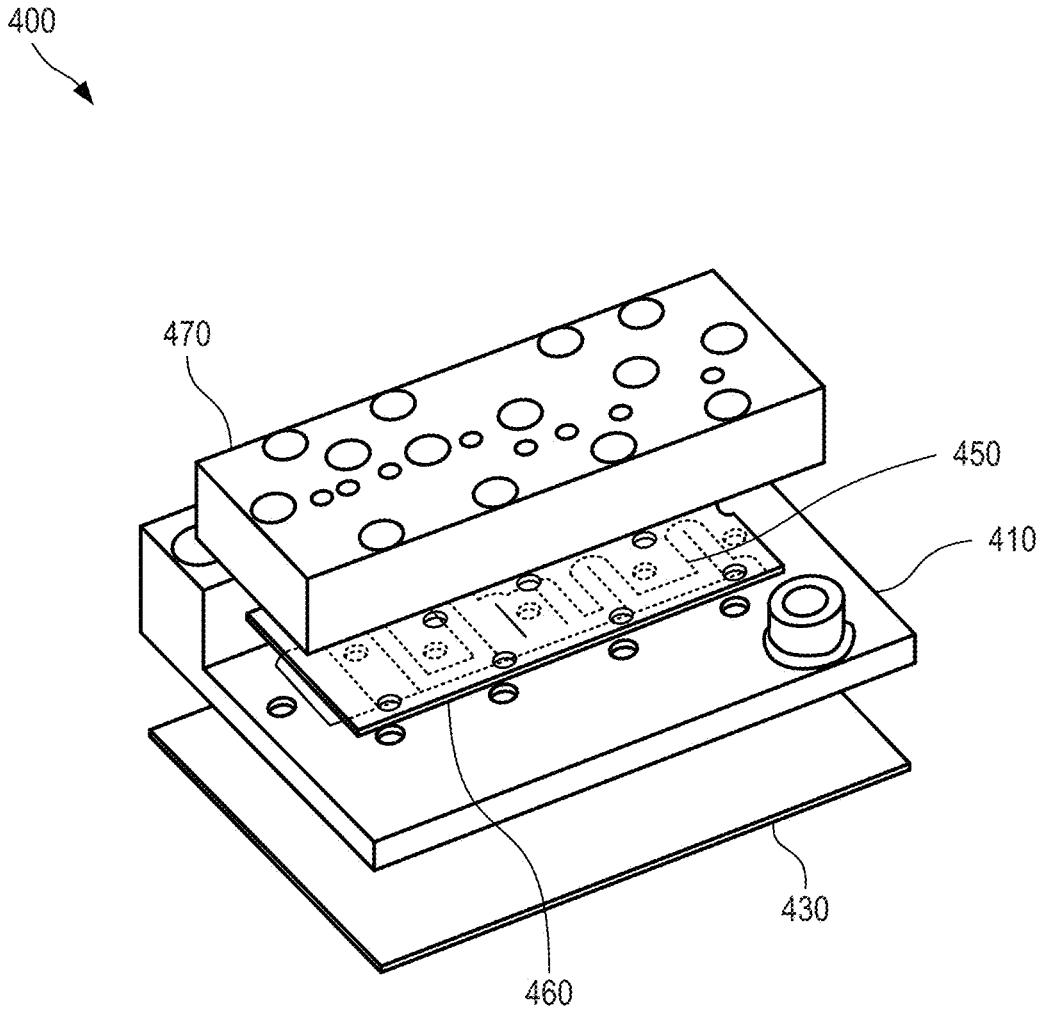
FIG. 4 is an exploded axonometric view depicting aspects of a microfluidic device according to certain aspects of the present disclosure.

FIG. 4 is an exploded axonometric view depicting aspects of a microfluidic device according to certain aspects of the present disclosure. As shown here, the microfluidic device 400 includes a substrate 410. The substrate 410 includes or is attached with a raised structure 450 that has one or more channels or grooves. The device 400 also includes an elastic membrane or elastomeric sheet 460 that overlies the raised structure 450 such that portions of the membrane and portions of the grooves form enclosed microfluidic channels. As further discussed elsewhere herein, the elastic membrane 460 can operate as a valve to open or close one or more microfluidic channels of the raised structure 450. Elastic membrane or elastomeric sheet 460 may be formed from an elastomeric material such as polydimethylsiloxane (PDMS). A manifold 470 is positioned on top of the elastic membrane 460 and can be used to apply or transfer force, pressure, or vacuum which operate to open or close the valve. Device 400 also includes a lamination film 430 that can function to provide one or more microfluidic channels on the lower surface of the substrate 410, as discussed elsewhere herein.

Figure 5:
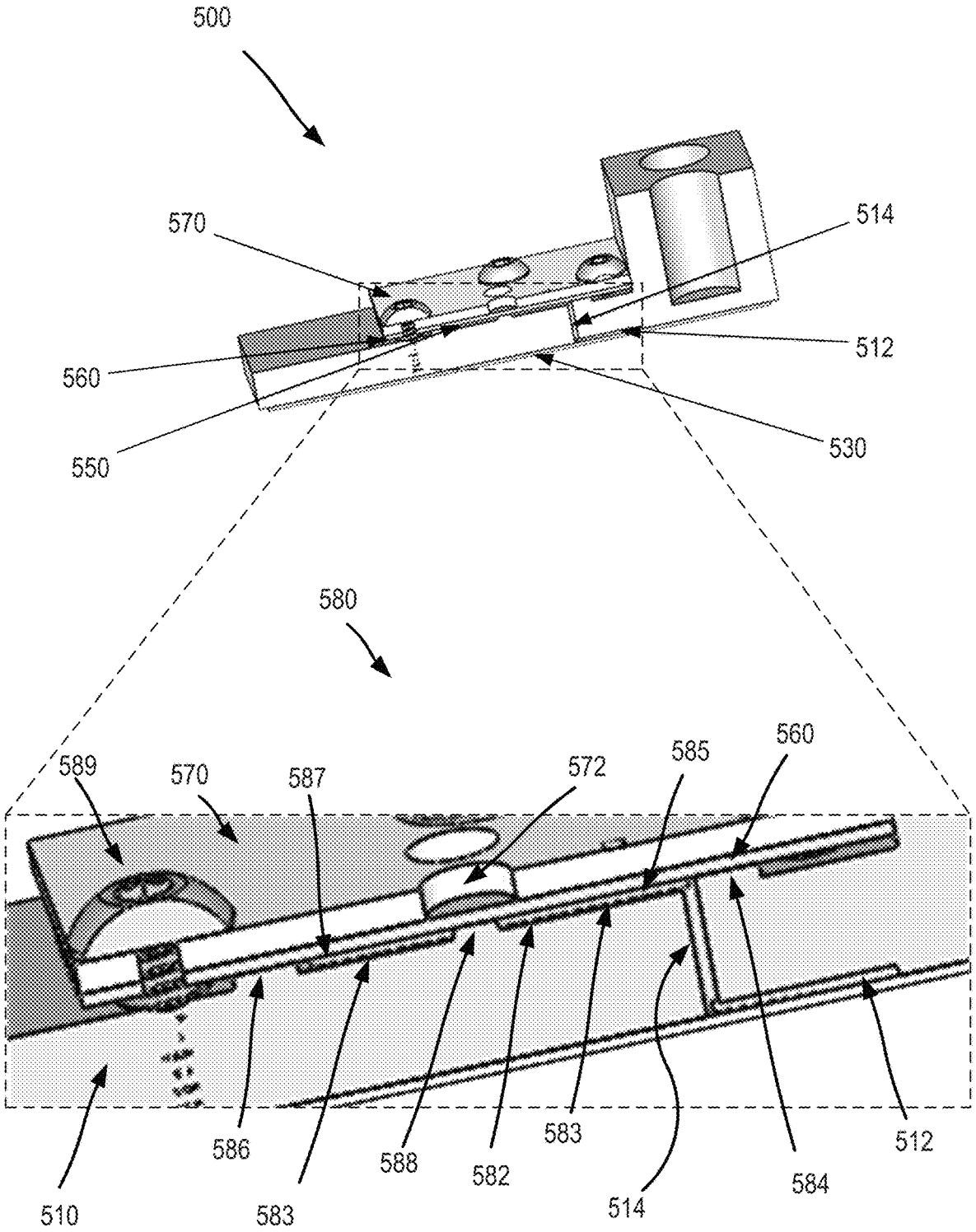
FIG. 5 is a combined axonometric view and close-up view depicting aspects of a microfluidic device according to certain aspects of the present disclosure.

FIG. 5 is a combined axonometric view and close-up view depicting aspects of a microfluidic device according to certain aspects of the present disclosure. As shown here, the microfluidic device 500 includes a substrate 510. The substrate 510 includes or is attached with a raised structure 550 that has one or more channels. The device 500 also includes an elastic membrane or elastomeric sheet 560 that is attached to or engaged with the raised structure 550 to form enclosed microfluidic channels. The elastic membrane 560 can operate as a valve to open or close one or more microfluidic channels of the raised structure 550. A manifold 570 is positioned on top of the elastic membrane 560 and can be used to apply or transfer pressure or vacuum which operates to open or close the valve. Device 500 also includes a lamination film 530 that can function to provide one or more microfluidic channels 512 on the lower surface of the substrate 510. A microfluidic channel 512 disposed on the lower surface of the substrate 510 can be in fluid communication with a microfluidic channel associated with the raised structure 550 via an aperture 514.

Hence, a valve assembly 580 can include a raised structure 582 having a floor 583, a proximal ridge 584 extending from the floor, a distal ridge 586 extending from the floor, and a stem 588 extending from the floor. The stem 588 is positioned between the proximal ridge 584 and the distal ridge 586. The valve assembly 580 can also include the manifold 570, and the manifold includes a control aperture 572 extending there through. The valve assembly 580 can also include the elastomeric sheet 560, and the elastomeric sheet 560 can be disposed between the raised structure 582 and the manifold 570. The elastomeric sheet 560 can be compressed by the manifold 570 against the proximal ridge 584 and the distal ridge 586, thereby forming a proximal channel 585 between the proximal ridge 584 and the stem 588, and a distal channel 587 between the stem 588 and the distal ridge 586.

The stem 588 is aligned with the control aperture 572. The elastomeric sheet 560 contacts the stem 588 when the elastomeric sheet 560 is in a sealing configuration, thereby preventing fluid communication between the distal channel 587 and the proximal channel 585. The elastomeric sheet 560 is separated from the stem 588 when the elastomeric sheet 560 is in a non-sealing configuration (e.g. when a negative pressure is present in the control aperture 572), thereby allowing fluid communication between the distal channel 587 and the proximal channel 585. In this way, an elastomeric sheet can operate to seal two separate channels under normal or default conditions, and can operate to connect the two separate channels when a vacuum or mechanical force is applied.

In some cases, a valve assembly 580 can include a pressure source in fluid communication with the control aperture 572. In some cases, the pressure source can include a positive pressure source. In some cases, the pressure source can include a negative pressure source. As shown here, the valve assembly can include one or more bolts 589, and the manifold 570 can include one or more corresponding apertures that receive such bolts 589, and the one or more bolts 589 can operate to compress the elastomeric sheet 560 between the manifold 570 and the proximal ridge 584 and distal ridge 586. In some cases, the distal channel 587 can be in fluid communication with a channel of the microfluidic device (e.g. channel 211*b* or channel 213*b* depicted in FIG. 2). According to some embodiments, a valve assembly can include one or more snap clamps. The snap clamps can be used in place of or in addition to the bolts, for purposes of compressing the elastomeric sheet between the manifold and the proximal and distal ridges.

Figure 6:
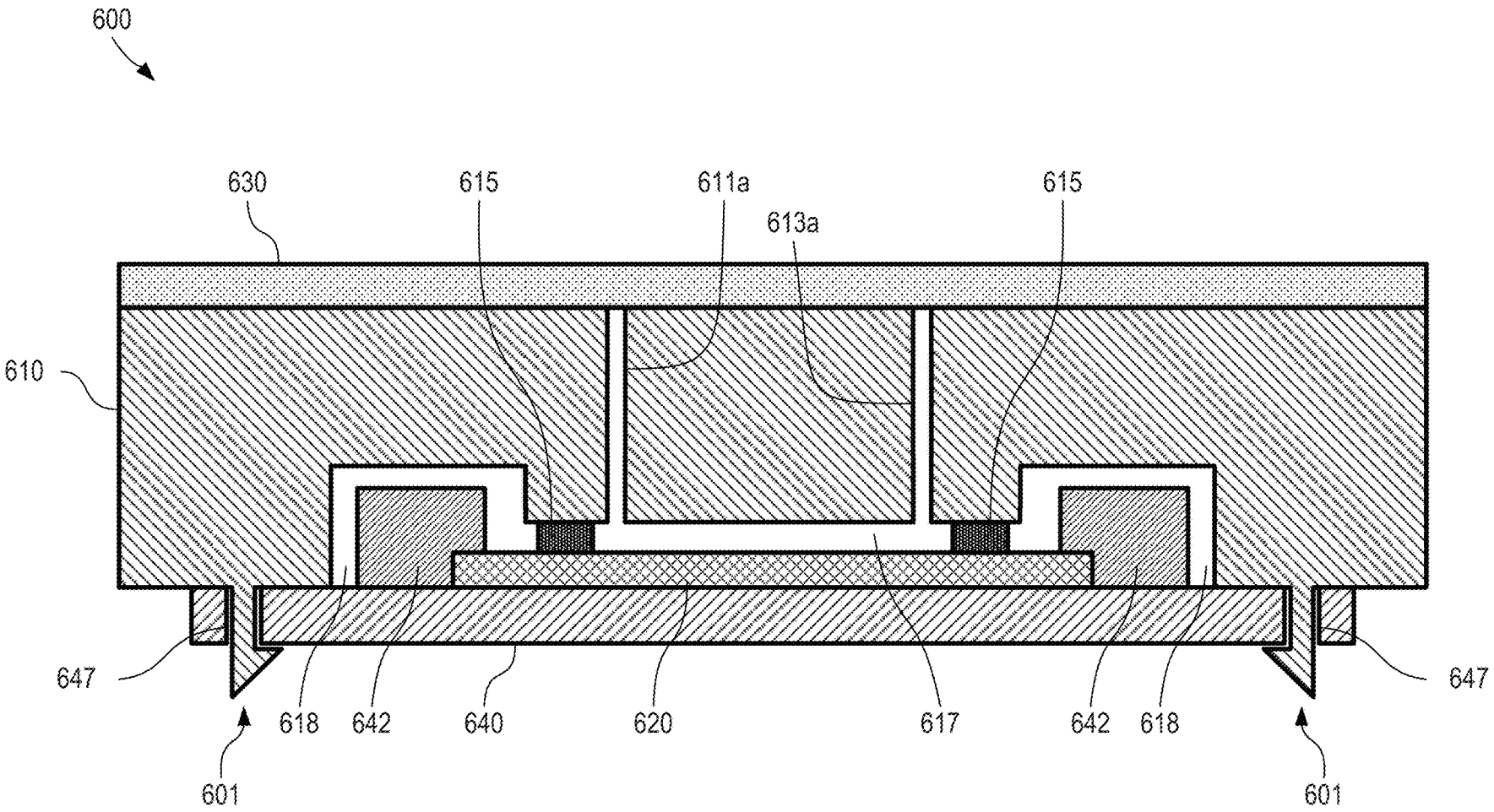
FIG. 6 is a cross-sectional view depicting aspects of a microfluidic device having an over-molded seal according to certain aspects of the present disclosure.

FIG. 6 is a cross-sectional view depicting aspects of a microfluidic device 600 having an over-molded seal according to certain aspects of the present disclosure. As shown here, device 600 includes a substrate 610, which can be an injection molded cartridge. In some cases, the substrate is an injection molded plastic. Device also includes sensor 620 (e.g. a live sensor), and a lamination film 630. An upper portion of the sensor 620 can be apposed with a lower portion of an over-molded elastomer 615 (e.g., elastomeric spacer), and an upper portion of the over-molded elastomer 615 can be apposed with a lower portion of the substrate 610. In some cases, the elastomer 615 operates as a spacer between the substrate 610 and the sensor 620.

As depicted here, the substrate 610 can have a first recessed groove (not shown; similar to first recessed or input groove 312 depicted in FIG. 3) and a second recessed groove (not shown; similar to second recessed or output groove 314 depicted in FIG. 3). The lamination film 630 can be adhered to the upper surface of the substrate 610 and can cover the first recessed groove and the second recessed groove, such that a first closed channel is formed by the lamination film 630 and the first recessed groove and a second closed channel is formed by the lamination film 630 and the second recessed groove.

The lower surface of the substrate 610 includes a recessed cavity, and the sensor 620 can cover the recessed cavity, such that a flow cell 617 is formed by the upper surface of the sensor 620, the elastomer 615, and the recessed cavity. In some cases, the elastomer spacer 615 can provide space between the first (e.g. upper) surface of the sensor 620 and the second (e.g. lower) surface of the substrate 610. In some cases, the depth of the flow cell 617 can be defined by the thickness of the elastomer spacer 615 after assembling. An upper surface or portion of the sensor 620 can include a detection mechanism (not shown; similar to detection mechanism 322 depicted in FIG. 3) such as an integrated circuit (IC) chip or electronic circuit layer that faces inward toward the interior of the flow cell 617. In some cases, the sensor 620 is configured to detect signals. In some cases, the sensor 620 is configured to detect visible light (e.g., fluorescence or luminescence, such as chemiluminescence). In some cases, the sensor is a complementary metal-oxide-semiconductor (CMOS) sensor. The first upper closed channel can be in fluid communication with the flow cell 617 via an aperture 611*a* that passes through the substrate 610 and second upper closed channel can be in fluid communication with the flow cell 617 via an aperture 613*a* that passes through the substrate 610.

A PCB 640 can be coupled with the substrate 610 and/or the sensor 620. For example, as depicted here, sensor 620 can be wire bonded (e.g. with one or more wire bonds 642) with the PCB 640 to provide an electronic connection there between. The substrate 610 can include a recess 618 that receives or houses the wire bond 642. This feature can operate to help protect the wire bond 642 from damage during assembly of the microfluidic cartridge substrate 610 and the silicon-based sensor 620.

In some embodiments, cartridge substrate 610 can also include one or more snap click features 601, which can pass through apertures 647 of PCB 640. In this way, the snap click features 601 can operate to provide or maintain a compression force between substrate 610 and PCB 640, which in turn helps provide a seal between elastomer 615 and substrate 610, as well as a seal between elastomer 615 and sensor 620.

Hence, it is possible to use an over molding method to over mold a layer of elastomer on injection molded plastic parts. The over-molded elastomer can be used as spacer and sealing interface when interfacing the injection molded part with the live sensor. A cavity can be formed by the elastomer spacer. A force used to seal between the elastomer and the live sensor can be provided by a snap click feature on the injection molded part as well. In some cases, a force used to seal between the elastomer and the live sensor can be provided using other techniques, such as bolts, adhesives, external devices, and the like.

Figure 7:
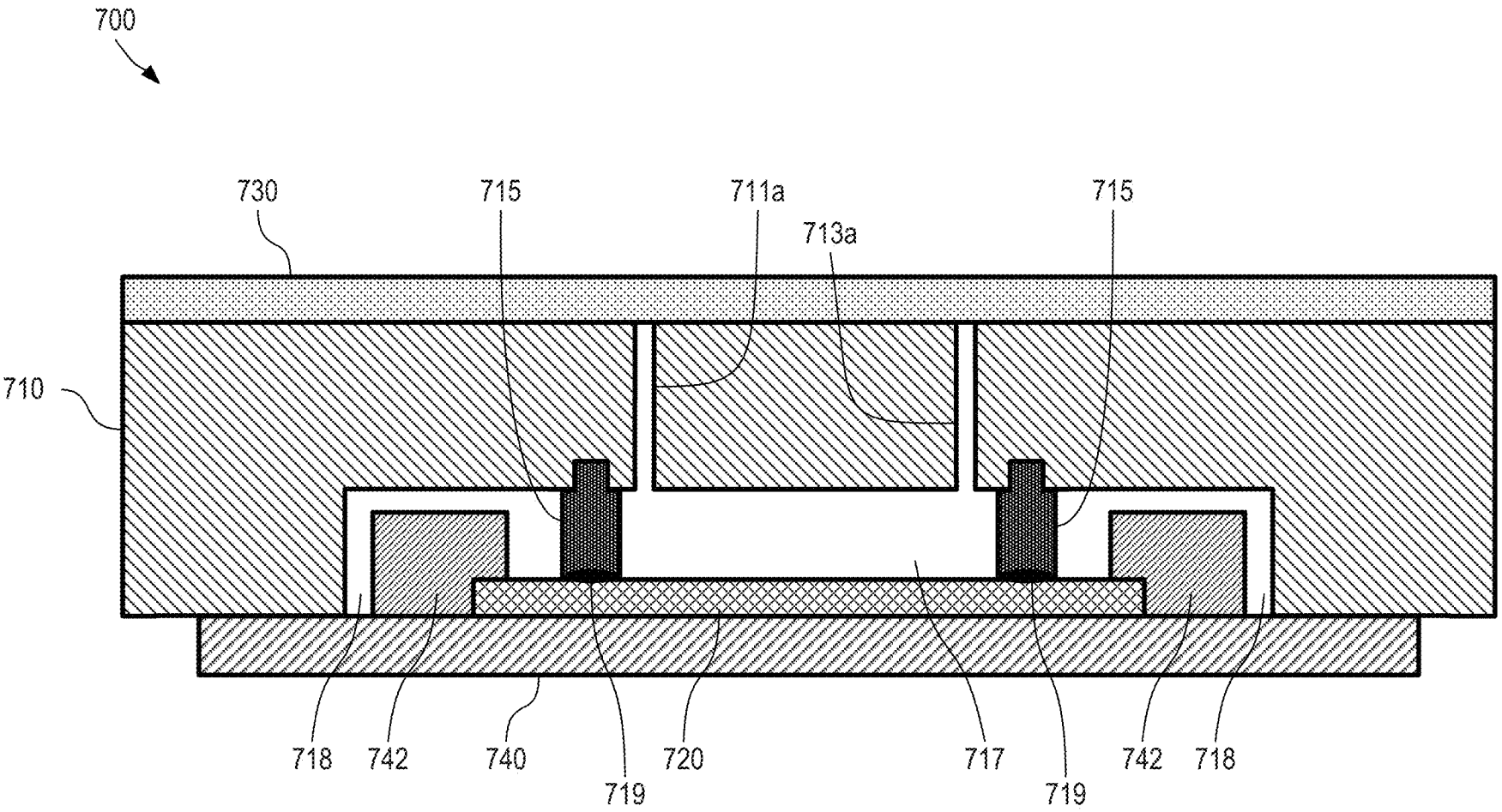
FIG. 7 is a cross-sectional view depicting aspects of a microfluidic device having an elastomeric seal according to certain aspects of the present disclosure.

FIG. 7 is a cross-sectional view depicting aspects of a microfluidic device 700 having an elastomeric seal (e.g., elastomeric spacer) according to certain aspects of the present disclosure. As shown here, device 700 includes a substrate 710, which can be an injection molded cartridge. In some cases, the substrate is an injection molded plastic. Device also includes sensor 720 (e.g. a live sensor), and a lamination film 730. An upper portion of the sensor 720 can be apposed with a lower portion of an elastomer 715, and an upper portion of the elastomer 715 can be apposed with a lower portion of the substrate 710. In some cases, the elastomer 715 operates as a spacer between the substrate 710 and the sensor 720.

The elastomer 715 can be an over-molded elastomer that is over-molded onto the substrate 710 during fabrication. In some cases, however, the elastomer 715 can be a separable elastomer that is separable from the substrate 710. For example, the elastomer 715 can be a ring (e.g., circular or not circular) of elastomeric material. The elastomer 715 can be at least partially recessed into a grove of the substrate, although that need not always be the case.

In some cases, the elastomer 715 can be coupled to the sensor 720, such as through the use of an adhesive 719. The elastomer 715 can be otherwise coupled to the sensor 720, such as through the use of chemical or physical treatments. In some cases, the elastomer 715 can be compressed against the sensor 720, such as through the use of external force or other force between the substrate 710 and the sensor 720.

As depicted here, the substrate 710 can have a first recessed groove (not shown; similar to first recessed or input groove 312 depicted in FIG. 3) and a second recessed groove (not shown; similar to second recessed or output groove 314 depicted in FIG. 3). The lamination film 730 can be adhered to the upper surface of the substrate 710 and can cover the first recessed groove and the second recessed groove, such that a first closed channel is formed by the lamination film 730 and the first recessed groove and a second closed channel is formed by the lamination film 730 and the second recessed groove.

The lower surface of the substrate 710 includes a recessed cavity, and the sensor 720 can cover the recessed cavity, such that a flow cell 717 is formed by the upper surface of the sensor 720, the elastomer 715, and the recessed cavity. In some cases, the elastomer spacer 715 can provide space between the first (e.g. upper) surface of the sensor 720 and the second (e.g. lower) surface of the substrate 710. In some cases, the depth of the flow cell 717 can be defined by the thickness of the elastomer spacer 715 after assembling. An upper surface or portion of the sensor 720 can include a detection mechanism (not shown; similar to detection mechanism 322 depicted in FIG. 3) such as an integrated circuit (IC) chip or electronic circuit layer that faces inward toward the interior of the flow cell 717. In some cases, the sensor 720 is configured to detect signals. In some cases, the sensor 720 is configured to detect visible light (e.g., fluorescence or luminescence, such as chemiluminescence). In some cases, the sensor is a complementary metal-oxide-semiconductor (CMOS) sensor. The first upper closed channel can be in fluid communication with the flow cell 717 via an aperture 711*a* that passes through the substrate 710 and second upper closed channel can be in fluid communication with the flow cell 717 via an aperture 713*a* that passes through the substrate 710.

A PCB 740 can be coupled with the substrate 710 and/or the sensor 720. For example, as depicted here, sensor 720 can be wire bonded (e.g. with one or more wire bonds 742) with the PCB 740 to provide an electronic connection there between. The substrate 710 can include a recess 718 that receives or houses the wire bond 742. This feature can operate to help protect the wire bond 742 from damage during assembly of the microfluidic cartridge substrate 710 and the silicon-based sensor 720.

Figure 8:
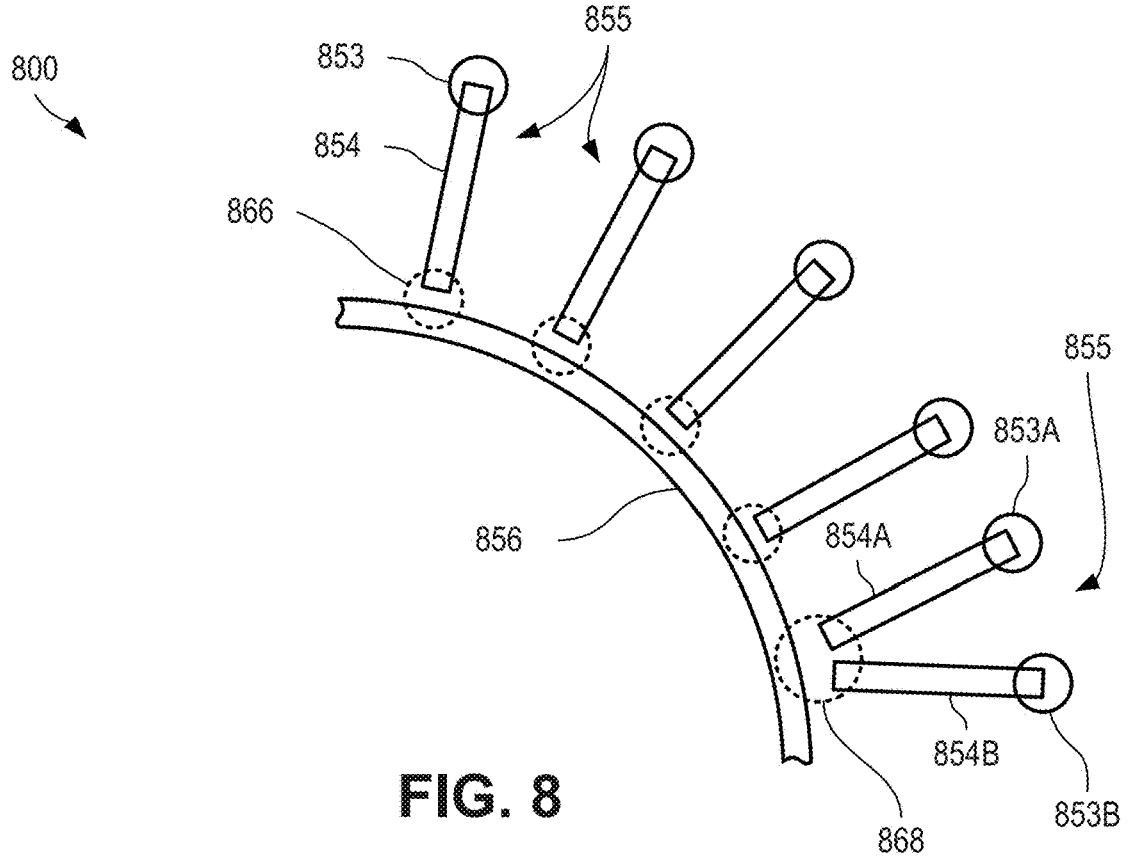
FIG. 8 is an schematic overhead view depicting an array of circular valves coupling a set of secondary channels to a common channel according to certain aspects of the present disclosure.

FIG. 8 is an schematic overhead view depicting an array 800 of circular valves coupling a set of secondary channels 854 to a common channel 856 according to certain aspects of the present disclosure. A common channel 856 can be fluidically couplable to multiple secondary channels 854 to be able to communicate fluids between the common channel 856 and each secondary channel 854. As depicted in FIG. 8, the valves 866 are circular in shape, although that need not always be the case. Additionally, common channel 856 is arced in shape, although that need not be the case.

A number of secondary channel groups 855 can be fluidically couplable with the common channel 856. Each secondary channel group 855 is associated with a valve 866. In some cases, a secondary channel group 855 can comprise a single secondary channel 854 fluidically coupling a single inlet 853 to the valve 866. In some cases, a secondary channel group 855 can comprise multiple secondary channels (e.g., secondary channels 854A, 854B) that is each fluidically coupled to a respective inlet (e.g., inlets 853A, 853B). Thus, when a secondary channel group 855 has two or more secondary channels, the opening of the valve 868 associated with that secondary channel group 855 can result in the fluidic coupling of multiple inlets (e.g., inlets 853A, 853B) to the common channel 856.

A valve 866 can be actuated to fluidically couple the respective secondary channel 854 or secondary channels 854A, 854B of a secondary channel group 855 to the common channel 856. The valves 866 of the array 800 can be opened individually or in any combination to achieve the desired result. For example, opening two valves can result in the mixture of two reagents from the secondary channels associated with those valves. In another example, a first valve can be opened for a period, after which a second valve can be opened for a period, which can be used to feed multiple reagents through the common channel 856, such as for mixing in a flow cell.

As used herein, the secondary channel 854 is described as coupling a valve 866 with an inlet 853. In such cases, fluid flow may pass from the inlet 853, through the secondary channel 854, and out into the common channel 856. However, in some cases, the secondary channel 854 can instead couple the valve 866 with an outlet, in which case the fluid flow may pass from the common channel 856 into the secondary channel 854 and out the outlet. An array 800 can include only secondary channel groups 855 associated with inlets 853, only secondary channel groups 855 associated with outlets, or a combination of secondary channel groups 855 associated with inlets 853 and secondary channel groups associated with outlets.

Figure 9:
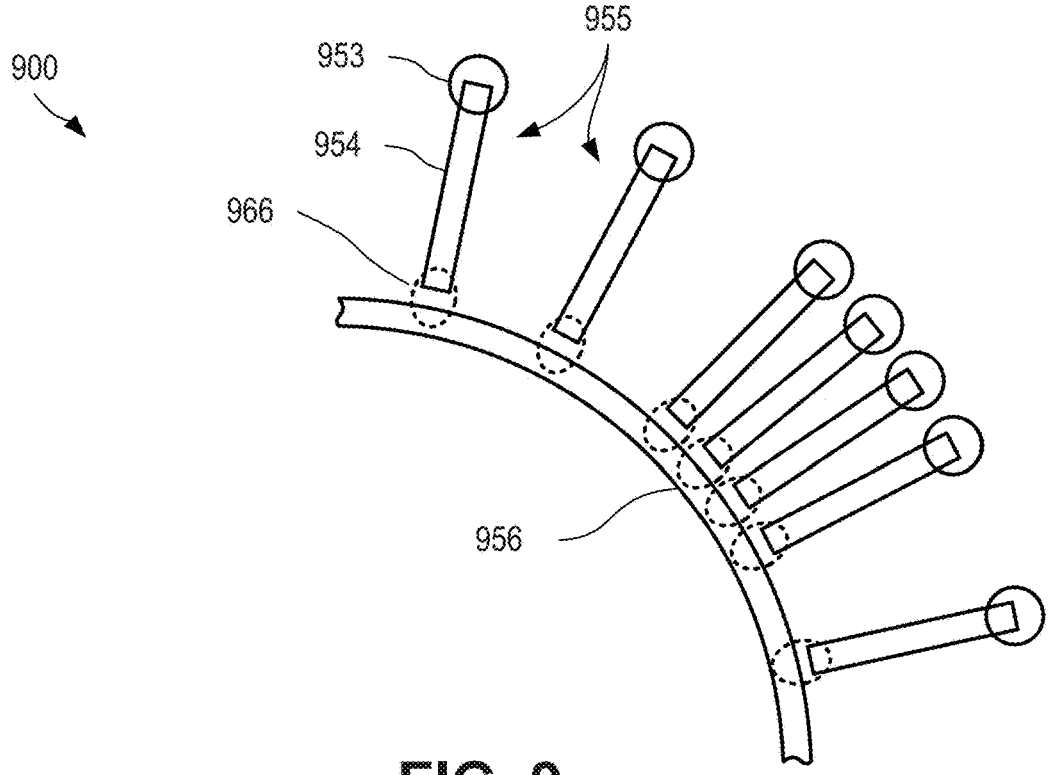
FIG. 9 is an schematic overhead view depicting an array of elliptical valves coupling a set of secondary channels to a common channel according to certain aspects of the present disclosure.

FIG. 9 is an schematic overhead view depicting an array 900 of elliptical valves coupling a set of secondary channels 954 to a common channel 956 according to certain aspects of the present disclosure. A common channel 956 can be fluidically couplable to multiple secondary channels 954 to be able to communicate fluids between the common channel 956 and each secondary channel 954. As depicted in FIG. 9, the valves 966 are elliptical in shape, although that need not always be the case. Additionally, common channel 956 is arced in shape, although that need not be the case.

A number of secondary channel groups 955 can be fluidically couplable with the common channel 956. Each secondary channel group 955 is associated with a valve 966. In some cases, a secondary channel group 955 can comprise a single secondary channel 954 fluidically coupling a single inlet 953 to the valve 966. In some cases, a secondary channel group can comprise multiple secondary channels, such as described herein with reference to FIG. 8.

A valve 966 can be actuated to fluidically couple the respective secondary channel 954 or secondary channels of a secondary channel group 955 to the common channel 956. The valves 966 of the array 900 can be opened individually or in any combination to achieve the desired result. For example, opening two valves can result in the mixture of two reagents from the secondary channels associated with those valves. In another example, a first valve can be opened for a period, after which a second valve can be opened for a period, which can be used to feed multiple reagents through the common channel 956, such as for mixing in a flow cell.

In some cases, the use of an elliptical valve 966 can beneficially permit closer-packing of valves 966, and thus permit a higher number of secondary channel groups 955 or a more desirable arrangement of secondary channel groups 955 on a microfluidic device (e.g., to improve layout on or reduce overall size of a microfluidic device).

As used herein, the secondary channel 954 is described as coupling a valve 966 with an inlet 953. In such cases, fluid flow may pass from the inlet 953, through the secondary channel 954, and out into the common channel 956. However, in some cases, the secondary channel 954 can instead couple the valve 966 with an outlet, in which case the fluid flow may pass from the common channel 956 into the secondary channel 954 and out the outlet. An array 900 can include only secondary channel groups 955 associated with inlets 953, only secondary channel groups 955 associated with outlets, or a combination of secondary channel groups 955 associated with inlets 953 and secondary channel groups associated with outlets.

Figure 10:
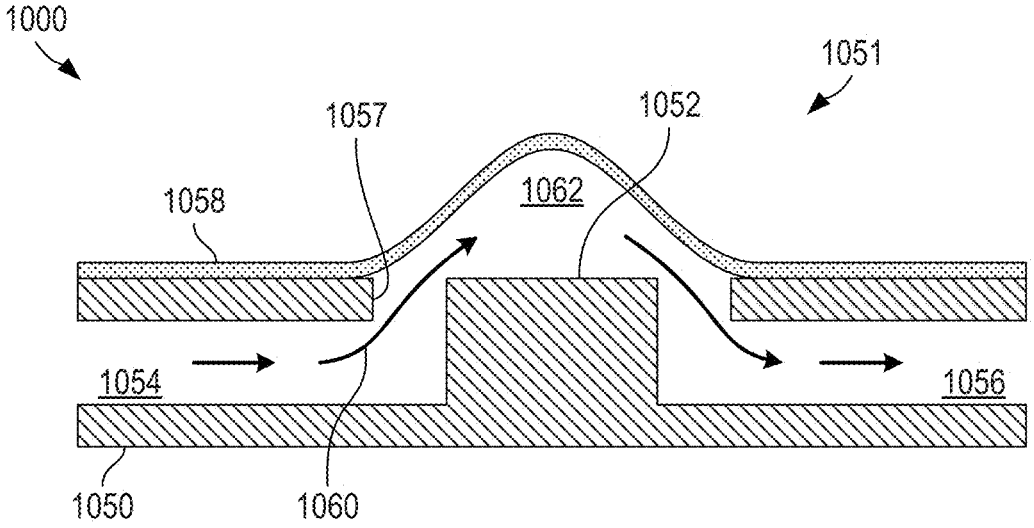
FIG. 10 is an cross-sectional view depicting a membrane valve in an open state according to certain aspects of the present disclosure.

FIG. 10 is an cross-sectional view depicting a membrane valve 1000 in an open state according to certain aspects of the present disclosure. A membrane valve 1000 can be used for valves 866, 966 of FIGS. 8,9. A membrane valve 1000 can act as an actuatable fluidic coupling between a first channel 1054 and a second channel 1056 (e.g., between a secondary channel 854, 954 and a common channel 856, 956 of FIGS. 8,9) of a substrate 1050.

A first channel 1054 and a second channel 1056 can pass through or terminate at a valve region 1051. The first channel 1054 and second channel 1056 can meet at an aperture 1057 in a top surface of the substrate 1050. A flexible membrane 1058 (e.g., a lamination film, such as lamination film 130 of FIG. 1) can be secured to the top surface of the substrate 1050. A valve seat 1052 can be located at the valve region 1051 and within the aperture 1057. As depicted in FIG. 10, the valve seat 1052 is flush with the top surface of the substrate 1050, although that need not always be the case (e.g., the valve seat can extend to a plane that is located between the top surface of the substrate 1050 and the bottom surface of the substrate 1050).

When the membrane valve 1000 is in an open state, a passage 1062 can be defined between the flexible membrane 1058 and the valve seat 1052. The passage 1062 can couple the first channel 1054 with the second channel 1056, permitting fluid flow 1060 between the channels. As depicted in FIG. 10, the flexible membrane 1058 naturally rests above the valve seat 1052 in a concave shape, although that need not always be the case (e.g., the flexible membrane 1058 can remain flat when the valve seat does not extend all the way to the top of the substrate 1050).

Figure 11:
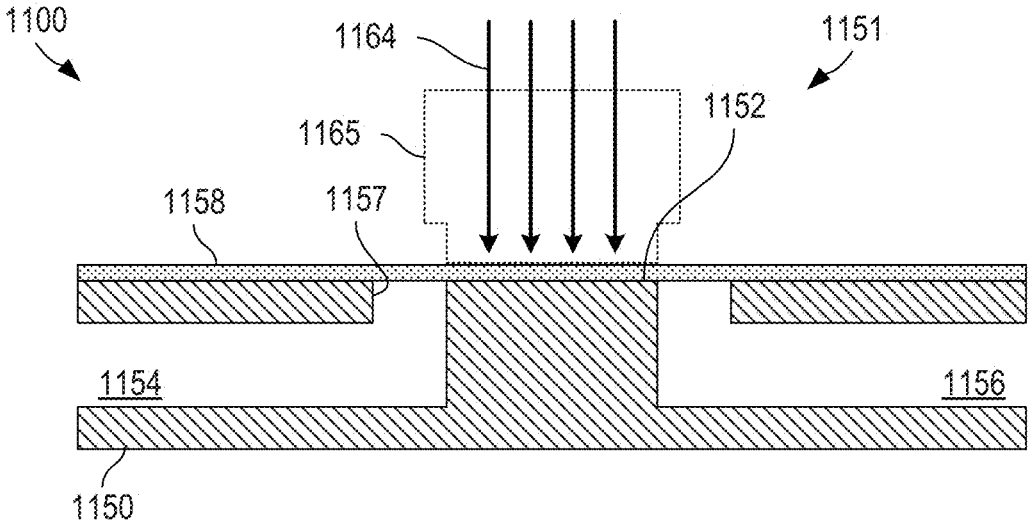
FIG. 11 is an cross-sectional view depicting a membrane valve in a closed state according to certain aspects of the present disclosure.

FIG. 11 is an cross-sectional view depicting a membrane valve 1100 in a closed state according to certain aspects of the present disclosure. Membrane valve 1100 can be membrane valve 1000 of FIG. 10 after being actuated into a closed state. The membrane valve 1100 can act as an actuatable fluidic coupling between a first channel 1154 and a second channel 1156 (e.g., between a secondary channel 854, 954 and a common channel 856, 956 of FIGS. 8,9) of a substrate 1150.

A first channel 1154 and a second channel 1156 can pass through or terminate at a valve region 1151. The first channel 1154 and second channel 1156 can meet at an aperture 1157 in a top surface of the substrate 1150. A flexible membrane 1158 (e.g., a lamination film, such as lamination film 130 of FIG. 1) can be secured to the top surface of the substrate 1150. A valve seat 1152 can be located at the valve region 1151 and within the aperture 1157. As depicted in FIG. 11, the valve seat 1152 is flush with the top surface of the substrate 1150, although that need not always be the case (e.g., the valve seat can extend to a plane that is located between the top surface of the substrate 1150 and the bottom surface of the substrate 1150).

When the membrane valve 1100 is in a closed state, the flexible membrane 1158 can be compressed against the valve seat 1152, thus forming a fluidic seal between the first channel 1154 and the second channel 1156. The fluidic seal can completely block fluid flow between the channels or can be configured to reduce fluid flow between the channels.

The membrane valve 1100 can be closed by applying a force 1164 against the flexible membrane 1158 to compress the flexible membrane 1158 against the valve seat 1152. Any suitable technique can be used to apply force 1164 to compress the flexible membrane 1158 against the valve seat 1152. In some cases, the force 1164 can be applied using a mechanical device 1165, such as a pin or cam. In some cases, the force 1164 can be applied through other techniques, such as through application of pressure. A manifold, such as manifold 470 of FIG. 4 can be used to apply the external force on the flexible membrane 1158.

The membrane valves 1000, 1100 depicted in FIGS. 10, 11 are normally open valves that remain open unless external force causes them to close. In some cases, however, a normally closed valve can be used, in which case external force (e.g., vacuum force) must be applied to open the valve.

Figure 12:
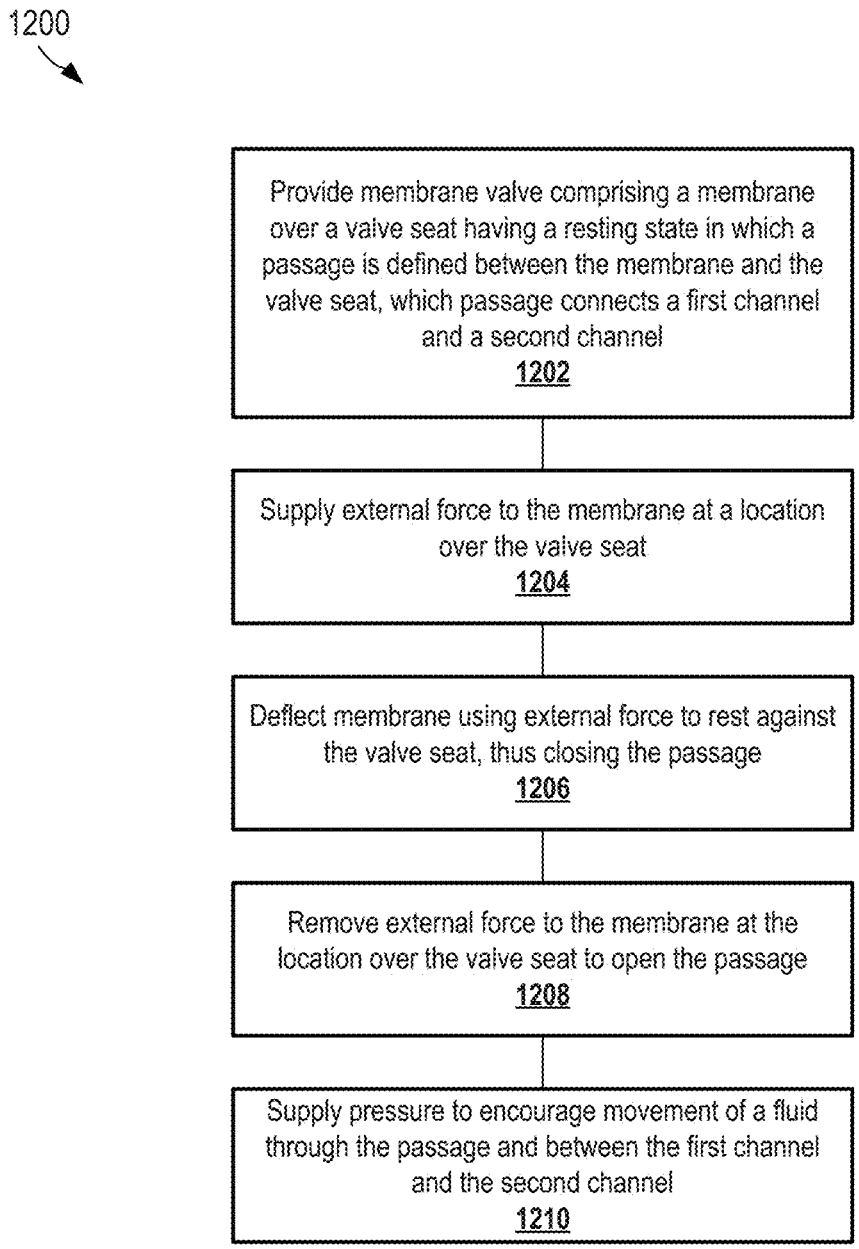
FIG. 12 is a flowchart depicting a process for actuating a membrane valve according to certain aspects of the present disclosure.

FIG. 12 is a flowchart depicting a process 1200 for actuating a membrane valve according to certain aspects of the present disclosure. At block 1202, a membrane valve is provided. The membrane valve can be provided as a membrane over a valve seat having a resting state in which a passage is defined between the membrane and the valve seat, which passage connects a first channel and a second channel. At block 1204, external force can be applied to the membrane at a location over the valve seat (e.g., a valve region). At block 1206, the membrane can be deflected using the external force applied at block 1204 until the membrane rests against or is compressed against the valve seat, thus closing the passage and blocking or reducing fluid flow. In some cases, the membrane can be deflected towards the valve seat at block 1206 without fully resting against the valve seat, thus providing a constricted passage that can reduce fluid flow or provide resistance against fluid flow. At block 1208, the external force can be removed from the membrane at the location over the valve seat to open the passage, thus permitting fluid flow between the first and second channels. At block 1210, a driving pressure can be supplied to encourage movement of a fluid through the passage and between the first channel and the second channel.

As described with respect to process 1200, a normally open valve is used and external force is applied to close the passage. However, in an alternate process similar to process 1200, a normally closed valve is used and the instances of external force being applied or removed are swapped as compared to process 1200.

Figure 13:
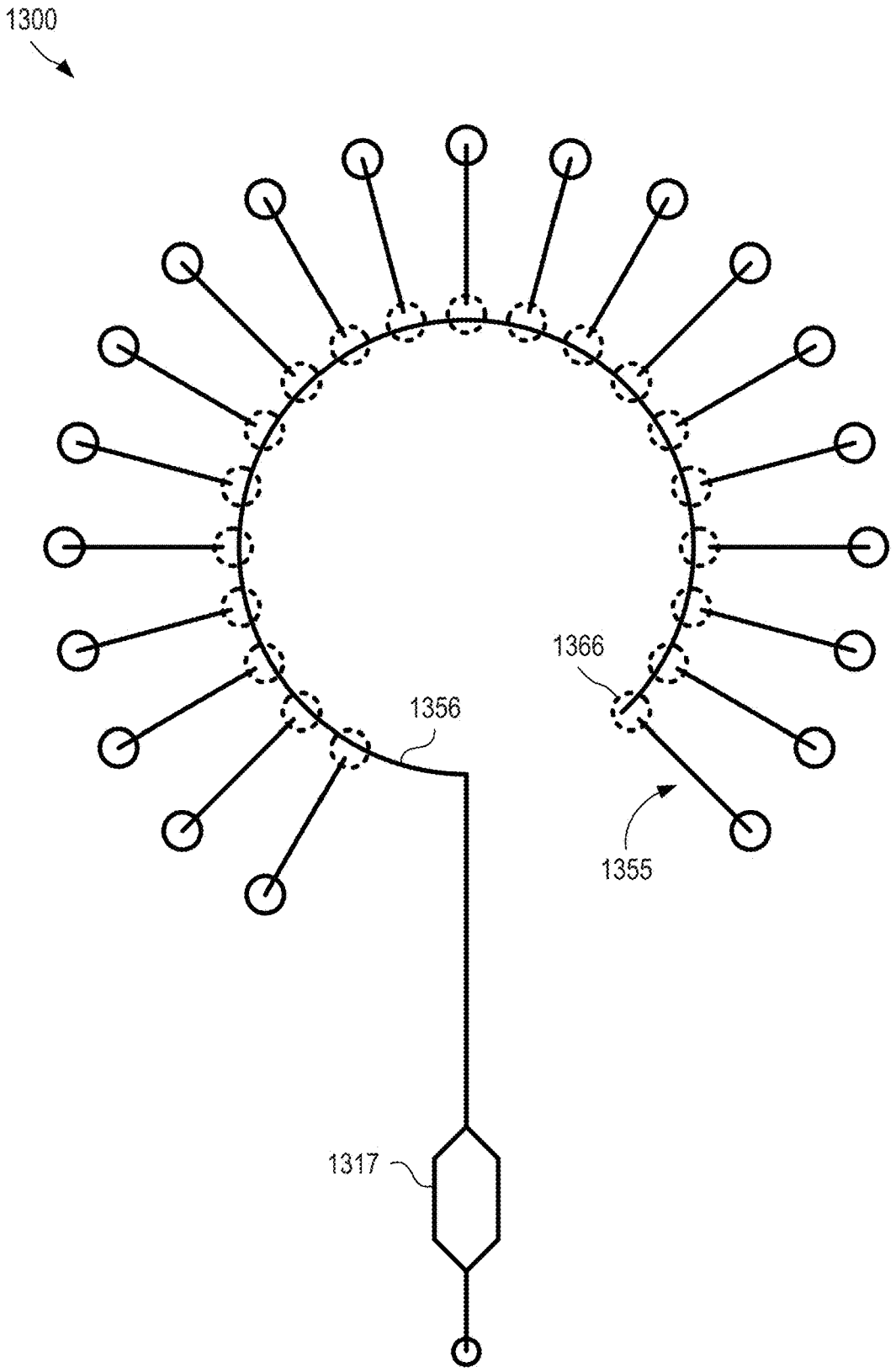
FIG. 13 is a circular array of membrane valves for providing reagents to a flow cell according to certain aspects of the present disclosure.

FIG. 13 is a circular array 1300 of membrane valves 1366 for providing reagents to a flow cell 1317 according to certain aspects of the present disclosure. The circular array 1300 comprises a common channel 1356 having a circular-shaped region (e.g., a semi-circle region) in which a number of secondary channel groups 1355 can be located. The common channel 1356 can feed into a flow cell 1317, such as flow cell 117 of FIG. 1, or any other suitable flow cell. In some cases, common channel 1356 can be fluidically coupled with other elements instead of or in addition to a flow cell 1317. Each secondary channel group 1355 can be coupled to one or more reagents, which can be provided to the common channel 1356, and thus the flow cell 1317, individually or in any suitable combination or sequence.

As depicted in FIG. 13, the valves 1366 of the secondary channel groups 1355 can be arranged circumferentially around the circular-shaped region of the common channel 1356. This circumferential arrangement can facilitate easy actuation of the valves 1366 of the array 1300. In some cases, a manifold or other mechanical device placed over the array 1300 can include pins or cams that can supply sufficient external force to close the valves 1366 of the array 1300. In some cases, the manifold or other mechanical device can contain a non-contacting region in which a valve 1366 underneath will not be closed and will remain open. Thus, by rotating the manifold or other mechanical device with respect to the array 1300 (e.g., around an axis of rotation concentric with the circular-shaped region of the common channel 1356), that non-contacting region can be rotated to a desired valve 1366, thus permitting easy selection of a secondary channel group 1355 with minimal moving parts (e.g., a single rotating part). In some cases, however, the valves 1366 of the circular array 1300 can be controlled using other techniques, such as individually addressable pins or pressure ports, as described herein.

Figure 14:
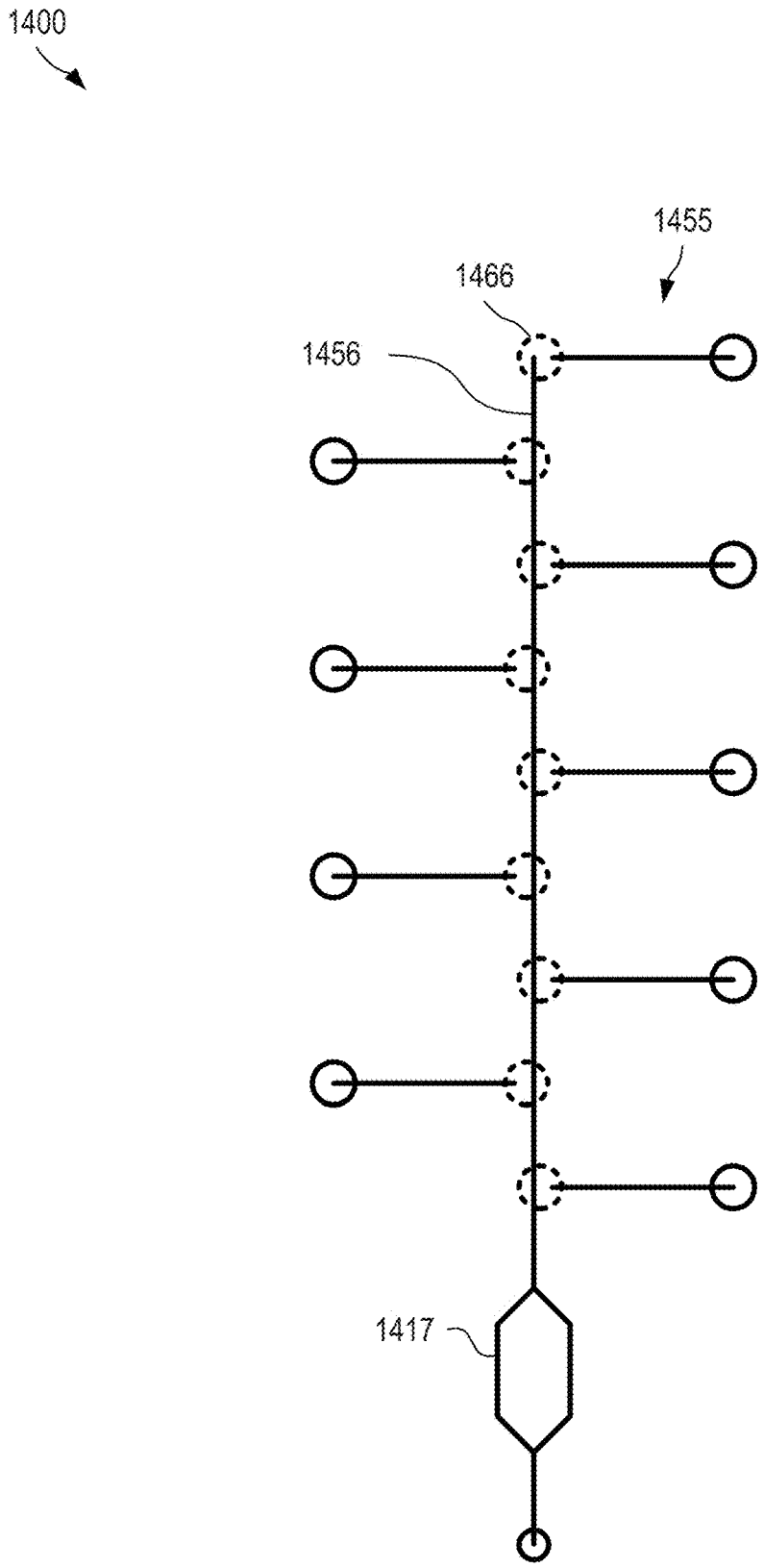
FIG. 14 is a linear array of membrane valves for providing reagents to a flow cell according to certain aspects of the present disclosure.

FIG. 14 is a linear array 1400 of membrane valves 1466 for providing reagents to a flow cell 1417 according to certain aspects of the present disclosure. The linear array 1400 comprises a common channel 1456 that extends linearly or substantially linearly (e.g. along one or multiple straight lines or along nearly straight lines) along which a number of secondary channel groups 1455 can be located. The common channel 1456 can feed into a flow cell 1417, such as flow cell 117 of FIG. 1, or any other suitable flow cell. In some cases, common channel 1456 can be fluidically coupled with other elements instead of or in addition to a flow cell 1417. Each secondary channel group 1455 can be coupled to one or more reagents, which can be provided to the common channel 1456, and thus the flow cell 1417, individually or in any suitable combination or sequence.

As depicted in FIG. 14, the valves 1466 of the secondary channel groups 1455 can be arranged along one or more linear or substantially linear paths. Each valve 1466 can be actuated individually by applying external force to the valve region at the valve 1466. In some cases, a manifold or other mechanical device placed over the array 1400 can provide the desired external forces. In some cases, each valve 1466 can be actuated using individually addressable pins or pressure ports, as described herein.

Figure 15:
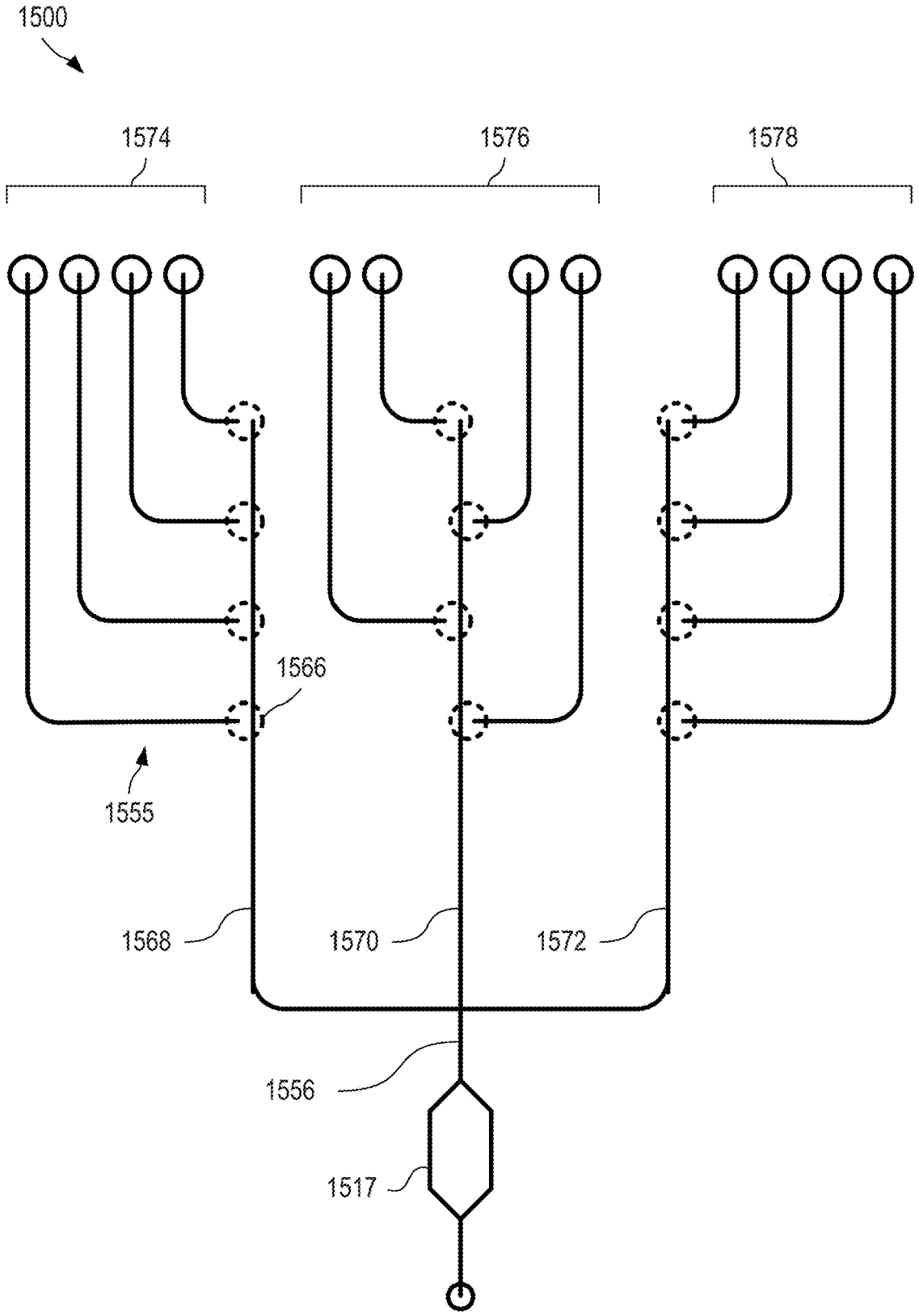
FIG. 15 is a branched array of membrane valves for providing reagents to a flow cell according to certain aspects of the present disclosure.

FIG. 15 is a branched array 1500 of membrane valves 1566 for providing reagents to a flow cell 1517 according to certain aspects of the present disclosure. The branched array 1500 comprises a common channel 1556 that can branch into a set of one or more branches (e.g., branches 1568, 1570, 1572). Each branch can have any suitable shape or can be its own array of valves (e.g., circular array 1300 of FIG. 13, linear array 1400 of FIG. 14, branched array 1500 of FIG. 15, or any other suitable array). As depicted in FIG. 15, each branch 1568, 1570, 1572 is a linear array of valves 1566.

The branched array 1500 permits different sets 1574, 1576, 1578 of secondary channel groups 1555 to be associated with respective branches 1568, 1570, 1572. Thus, the secondary channel groups 1555 of set 1574 are associated with branch 1568; the secondary channel groups 1555 of set 1576 are associated with branch 1570; and the secondary channel groups 1555 of set 1578 are associated with branch 1572. Each branch 1568, 1570, 1572 can feed into the common channel 1556. In some cases, an optional valve can be used to fluidically couple a branch to the common channel 1556, although that need not be the case. The common channel 1556 can feed into a flow cell 1517, such as flow cell 117 of FIG. 1, or any other suitable flow cell. In some cases, common channel 1556 can be fluidically coupled with other elements instead of or in addition to a flow cell 1517. Each secondary channel group 1555 can be coupled to one or more reagents, which can be provided, via respective branches 1568, 1570, 1572, to the common channel 1556, and thus the flow cell 1517, individually or in any suitable combination or sequence.

Due to the branched nature of the branched array 1500, multiple reagents or multiple types of reagents or other materials can be easily provided in combination or sequence to the common channel 1556. Additionally, the branched nature permits different types of reagents to be separated for longer, thus avoiding some amount of cross contamination of no branched array were used. For example, a branched array 1500 can be set up so that the set 1574 of secondary channel groups 1555 associated with branch 1568 are used for pre-sequencing reagents (e.g., surface treatments), the set 1576 of secondary channel groups 1555 associated with branch 1570 are used for during-sequencing reagents (e.g., sequencing reagents), and the set 1578 of secondary channel groups 1555 associated with branch 1572 are used for post-sequencing reagents (e.g., washing or flushing materials). Thus, the pre-sequencing, during-sequencing, and post-sequencing reagents are kept separated from one another and are unable to mix within the individual branches, with any potential for mixing or cross contamination occurring only within the common channel 1556.

The valves 1566 of the branched array 1500 can be actuated using any of the techniques described herein, such as through the use of a manifold or other mechanical device. In some cases, each valve 1566 can be actuated using individually addressable pins or pressure ports, as described herein.

Figure 16:
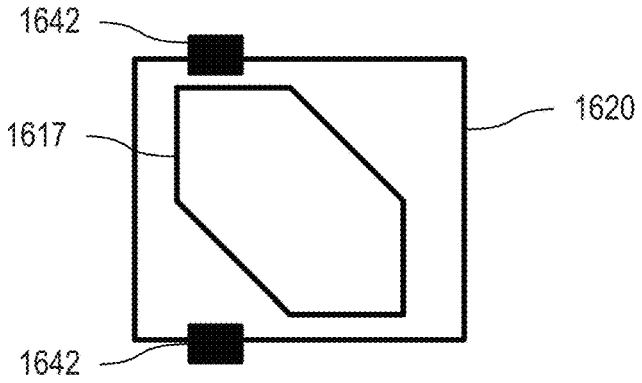
FIG. 16 is a schematic overhead view depicting a flow cell positioned entirely within the boundary of a sensor according to certain aspects of the present disclosure.

FIG. 16 is a schematic overhead view depicting a flow cell 1617 positioned entirely within the boundary of a sensor 1620 according to certain aspects of the present disclosure. The sensor 1620 can include a set of electrodes 1642 (e.g., wire bonds) used to convey sensor information to a PCB or other circuit. The sensor 1620 can have a surface (e.g., a sensing surface) that has a boundary defined by the edges of the surface. Flow cell 1617 can be positioned entirely within the boundary of the sensor 1620, thus ensuring that all material passing through the flow cell 1617 will be exposed to the sensor 1620.

Figure 17:
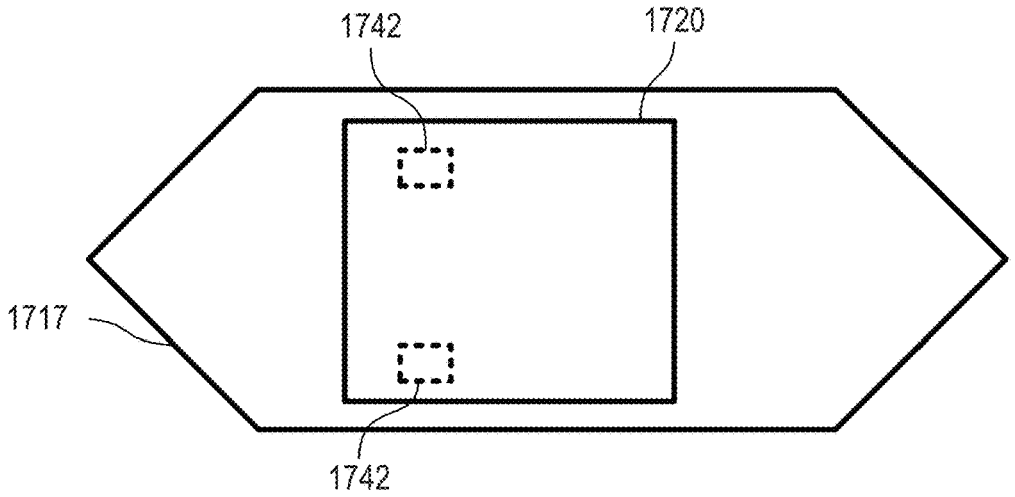
FIG. 17 is a schematic overhead view depicting a sensor positioned entirely within a flow cell according to certain aspects of the present disclosure.

FIG. 17 is a schematic overhead view depicting a sensor 1720 positioned entirely within a flow cell 1717 according to certain aspects of the present disclosure. The sensor 1720 can be placed entirely within the boundaries of the flow cell 1717. To ensure the electrodes 1742 (e.g., wire bonds) are not harmed and/or do not interfere with any sample being analyzed, the electrodes 1742 can be present on the opposite side of the sensor from the flow cell 1717 (e.g., the opposite side of the sensor from the imaging area). In such cases, the area surrounding the sensor 1720, which can be the PCB surface, can be coated or treated, such as with a thin film or additional substrate, to define the remaining boundary of the flow cell 1717 not defined by the sensor 1720 on that side of the flow cell 1717. When the entire sensor 1720 is positioned within the flow cell 1717, the entire sensor can be used, thus enabling one to take advantage of the entire resolution or area of a sensor. The arrangement depicted in FIG. 17 can be especially useful where it is not necessary or desired to ensure all material passing through the flow cell 1617 is exposed to the sensor 1620.

Figure 18:
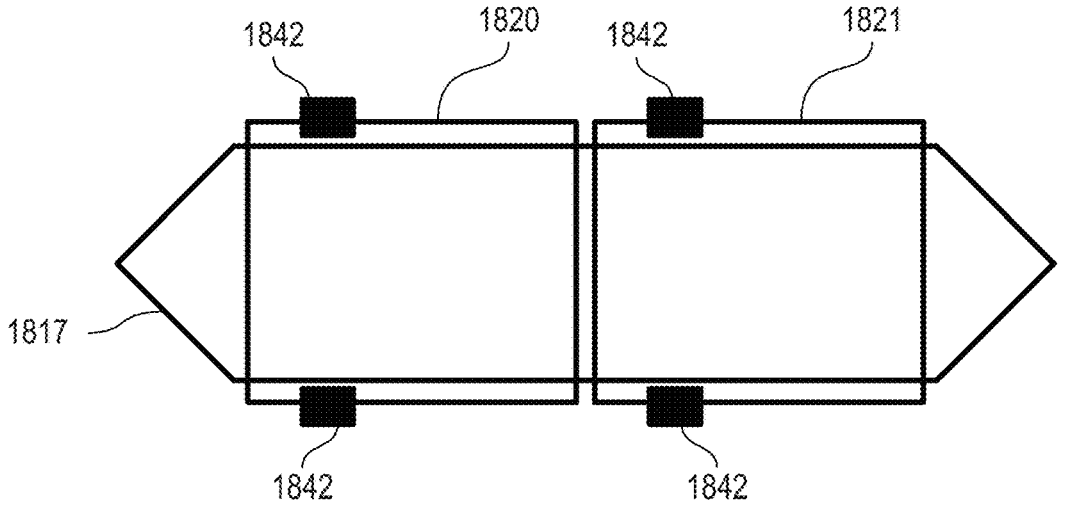
FIG. 18 is a schematic overhead view depicting a flow cell associated with multiple sensors according to certain aspects of the present disclosure.

FIG. 18 is a schematic overhead view depicting a flow cell 1817 associated with multiple sensors 1820, 1821 according to certain aspects of the present disclosure. The flow cell 1817 can be associated with any number of sensors, such as two sensors 1820, 1821 depicted in FIG. 18. Each of the sensors 1820, 1821 can include electrodes 1842 (e.g., wire bonds), which can be located outside of the flow cell 1817 (e.g., outside the boundaries of the flow cell 1817 as viewed in FIG. 18 or below the flow cell, such as depicted in FIG. 17). In some cases, one, some, or all of the sensors 1820, 1821 may be located partially within the bounds of the flow cell 1817, as depicted in FIG. 18, although that need not always be the case. In some cases, one, some, or all of the sensors 1820, 1821 may be located entirely within the bounds of the flow cell 1817, such as described with reference to FIG. 17. Any area surrounding the sensors 1820, 1821, which can be the PCB surface, can be coated or treated, such as with a thin film or additional substrate, to define the remaining boundary of the flow cell 1817 not defined by the sensors 1820, 1821 on that side of the flow cell 1817.

The use of multiple sensors 1820, 1821 in association with a single flow cell 1817 can permit the use of multiple sensors that are each smaller, less expensive, lower-power, and otherwise preferable to a single sensor and achieve the same or better results than the single sensor. In some cases, the use of multiple sensors 1820, 1821 can improve resolution of the sensed data. In some cases, the use of multiple sensors 1820, 1821 can improve the throughput of the assay without requiring a customized sensor. In some cases, first sensor 1820 and second sensor 1821 can be different types of sensors capable of sensing different types of information associated with the fluid and/or material within the flow cell 1817.

The present inventions find use in the field of massively parallel DNA sequencing (MPS). DNA sequencing technologies are well known (see, e.g., Shendure & Ji, 2008, "Next-generation DNA sequencing," *Nature Biotechnology* 26:1135-45). One approach to DNA sequencing is fashioned "sequencing-by-synthesis" or "SBS," and involves the iterative incorporation of deoxyribonucleotide triphosphates (dNTPs) or dNTP analogs into a growing DNA strand that is complementary to a template nucleic acid. In one approach, at most one dNTP is incorporated into the growing strand in each sequencing "cycle" and the incorporation is detected. For example, a common DNA sequencing method comprises iteratively labeling a growing DNA strand with a fluorescent label that identifies a nucleotide base at a particular position in the nucleic acid macromolecule and detecting the fluorescent label associated with the nucleic acid macromolecule by illuminating the nucleic acid macromolecule with excitation light.

In some approaches DNA sequencing is carried out in an ordered array. See, e.g., Drmanac et al., 2010, "Human genome sequencing using unchained base reads on self-assembling DNA nanoarrays," *Science* 327:78-81; (ordered array of DNA nanoballs) and WO2013188582 and US20120316086 (ordered array of clonal clusters). In one prior art SBS approach, sequencing occurs on a CMOS semiconductor chip comprising an ion sensitive layer comprising an array of microwells, below which is an ISFET ion sensor. In this approach hydrogen ions released during the process of DNA synthesis are detected by an ion sensor.

In an approach to MPS contemplated by the inventors, an ordered array of DNA binding regions is produced on or above a sensor, such as a CMOS sensor, that detects optical signals such as a fluorescence or luminescence signal.

In sequencing-by-synthesis methods, each sequencing cycle may involve a series of discrete steps including, for illustration and not limitation, one of more of the following: Introducing nucleic acid templates (e.g., DNA nanoballs or unamplified templates); introducing agents that result in clonal amplification of templates (e.g., polymerase, primers, dNTPs); removing reagents and soluble products post-amplification; introducing reagents (e.g., one or more labeled dNTPs and nucleic acid polymerase) that result in incorporation of a nucleoside into the growing strands, where the nucleoside is optionally labeled (e.g., with a fluorescent or chemiluminescent label); removing the introduced reagents; exposing the growing strands to conditions in which the incorporation is detected (e.g., illumination, or by introducing agents that react with a chemiluminescent label to produce signal); treating the strands with agents (e.g., phosphine) that cleave label from the growing strand and/or cleave reversible terminator blocking groups; removing the released label and/or blocking groups; introducing wash reagents between steps) and the like. In one approach, for example, the channels and valves of the microfluidic device described herein are used to deliver reagents to the flow cell comprising the nucleic acid templates, in an order and under conditions that allow for multiple cycles of: incorporation of a dNTP analog at a free 3-prime terminus of growing stand, detection of the incorporation, and regenerating the growing stand terminus so that a new dNTP analog may be incorporated.

The present specification provides a complete description of the methodologies, systems and/or structures and uses thereof in example aspects of the presently-described technology. Although various aspects of this technology have been described above with a certain degree of particularity, or with reference to one or more individual aspects, those skilled in the art could make numerous alterations to the disclosed aspects without departing from the spirit or scope of the technology hereof. Since many aspects can be made without departing from the spirit and scope of the presently described technology, the appropriate scope resides in the claims hereinafter appended. Other aspects are therefore contemplated. Furthermore, it should be understood that any operations may be performed in any order, unless explicitly claimed otherwise or a specific order is inherently necessitated by the claim language. It is intended that all matter contained in the above description and shown in the accompanying drawings shall be interpreted as illustrative only of particular aspects and are not limiting to the embodiments shown. Unless otherwise clear from the context or expressly stated, any concentration values provided herein are generally given in terms of admixture values or percentages without regard to any conversion that occurs upon or following addition of the particular component of the mixture. To the extent not already expressly incorporated herein, all published references and patent documents referred to in this disclosure are incorporated herein by reference in their entirety for all purposes. Changes in detail or structure may be made without departing from the basic elements of the present technology as defined in the following claims.

As used below, any reference to a series of examples is to be understood as a reference to each of those examples disjunctively (e.g., "Examples 1-4" is to be understood as "Examples 1, 2, 3, or 4").

Example 1 is a microfluidic device comprising: a plastic substrate having a first surface and a second surface, the first and second surfaces disposed on opposite sides of the plastic substrate; a sensor having a first surface and a second surface, the first surface comprising an electronic circuit layer; and a lamination film; wherein the first surface of the plastic substrate comprises an input recessed groove and an output recessed groove, wherein the second surface of the plastic substrate comprises a recessed cavity, wherein the lamination film is adhered to the first surface of the plastic substrate and covers the input recessed groove and the output recessed groove, such that an input closed channel is formed by the lamination film and the input recessed groove and an output closed channel is formed by the lamination film and the output recessed groove, wherein the sensor covers the recessed cavity, such that a flow cell is formed by the first surface of the sensor and the recessed cavity, wherein the input closed channel is fluidly connected with the flow cell, and wherein the output closed channel is fluidly connected with the flow cell.

Example 2 is the microfluidic device of example(s) 1, further comprising a second lamination film, wherein the second surface of the plastic substrate comprises a second input recessed groove and a second output recessed groove, wherein the second lamination film is adhered to the second surface of the plastic substrate and covers the input recessed groove and the output recessed groove, such that a second input closed channel is formed by the second lamination film and the second input recessed groove and a second output closed channel is formed by the second lamination film and the second output recessed groove, and wherein the input closed channel is fluidly connected with the second input closed channel and the output closed channel is fluidly connected with the second output closed channel, such that the input closed channel provides fluid communication between the second input closed channel and the flow cell and the output closed channel provides fluid communication between the second output closed channel and the flow cell.

Example 3 is the microfluidic device of example(s) 2, wherein the input closed channel is fluidly connected with the second input closed channel by an input via positioned within the plastic substrate and the output closed channel is fluidly connected with the second output closed channel by an output via positioned within the plastic substrate.

Example 4 is the microfluidic device of example(s) 1-3, wherein the plastic substrate comprises an injection molded plastic.

Example 5 is the microfluidic device of example(s) 1-4, wherein the plastic substrate comprises a member selected from the group consisting of cyclic olefin polymer (COP), polymethyl methacrylate (PMMA), polycarbonate (PC), and polypropylene (PP).

Example 6 is the microfluidic device of example(s) 1-5, wherein the plastic substrate is optically transparent.

Example 7 is the microfluidic device of example(s) 1-6, further comprising a printed circuit board coupled with the second surface of the sensor.

Example 8 is the microfluidic device of example(s) 1-7, further comprising a wire bond, wherein the second surface of the plastic substrate further comprises a recess that receives the wire bond.

Example 9 is the microfluidic device of example(s) 1-8, further comprising a valve assembly that controls flow through the input closed channel and the output closed channel, the valve assembly comprising: a manifold comprising an input control aperture and an output control aperture; an elastomeric sheet disposed between the manifold and the upper surface of the plastic substrate; and a raised structure extending from the upper surface of the plastic substrate toward the elastomeric sheet, the raised structure comprising an input proximal ridge, an input distal ridge, an input stem positioned between the input proximal ridge and the input distal ridge, an output proximal ridge, an output distal ridge, and an output stem positioned between the output proximal ridge and the output distal ridge, wherein the elastomeric sheet is compressed by the manifold against the input proximal and distal ridges and the output proximal and distal ridges, thereby forming an input proximal channel between the input proximal ridge and the input stem, an input distal channel between the input stem and the input distal ridge, an output proximal channel between the output proximal ridge and the output stem, and an output distal channel between the output stem and the output distal ridge, wherein the input stem is aligned with the input control aperture and the output stem is aligned with the output control aperture, wherein elastomeric sheet contacts the input and output stems when the elastomeric sheet is in a default sealing configuration, thereby preventing fluid communication between the input distal channel and the input proximal channel and between the output distal channel and the output proximal channel, wherein the contact sheets is separated from the input stem when a negative pressure is present in the input control aperture, thereby allowing fluid communication between the input distal channel and the input proximal channel, and wherein the contact sheets is separated from the output stem when a negative pressure is present in the output control aperture, thereby allowing fluid communication between the output distal channel and the output proximal channel.

Example 10 is the microfluidic device of example(s) 1-9, further comprising a set of secondary channel groups each comprising a secondary channel fluidically coupling a reagent inlet to a valve, wherein each valve is fluidically coupled to the input closed channel and actuatable between an open state permitting fluid flow through the valve and a closed state restricting fluid flow through the valve.

Example 11 is the microfluidic device of example(s) 10, wherein at least one of the set of secondary channel groups comprises an additional secondary channel fluidically coupling an additional reagent inlet to the valve.

Example 12 is the microfluidic device of example(s) 10 or 11, wherein each of the valves are arranged circumferentially around a circular-shaped portion of a common channel fluidically coupled to the input closed channel.

Example 13 is the microfluidic device of example(s) 10-12, wherein the set of secondary channel groups comprises a first subset of secondary channel groups and a second subset of secondary channel groups, wherein the first subset is distinct from the second subset, wherein the first subset of secondary channel groups is fluidically coupled to a common channel through a first branch channel, wherein the second subset of secondary channel groups is fluidically coupled to the common channel through a second branch channel, and wherein the common channel is fluidically coupled to the input closed channel.

Example 14 is the microfluidic device of example(s) 1-13, further comprising a membrane valve that controls fluid flow through the input closed channel, the membrane valve comprising: an aperture in a surface of the substrate selected from the group consisting of the first surface and the second surface, wherein a flexible membrane is secured to the surface over the aperture; a valve seat positioned within the aperture; a first channel of the plastic substrate and a second channel of the plastic substrate fluidically coupled through the aperture by a passage defined at least in part by a space between the flexible membrane and the valve seat, wherein the flexible membrane is compressible against the valve seat to seal the passage and restrict fluid flow between the first channel and the second channel, and wherein one of the first channel and the second channel is fluidically coupled to the input closed channel.

Example 15 is the microfluidic device of example(s) 1-14, wherein the plastic substrate is secured to the sensor by an adhesive.

Example 16 is the microfluidic device of example(s) 1-15, wherein the plastic substrate further comprises an elastomeric spacer positioned to engage the sensor covering the recessed cavity such that the flow cell is further formed by the elastomeric spacer.

Example 17 is the microfluidic device of example(s) 1-16, wherein the sensor is supported on a substrate, and wherein the flow cell is further formed by the substrate such that the entire first surface of the sensor is disposed within a boundary of the flow cell.

Example 18 is the microfluidic device of example(s) 1-17, further comprising an additional sensor, wherein recessed cavity is further covered by the additional sensor such that the flow cell is further formed by a first surface of the additional sensor.

Example 19 is a valve assembly for a microfluidic device, comprising: a raised structure having a floor, a proximal ridge extending from the floor, a distal ridge extending from the floor, and a stem extending from the floor, the stem positioned between the proximal ridge and the distal ridge; a manifold having a control aperture; an elastomeric sheet disposed between the raised structure and the manifold; wherein the elastomeric sheet is compressed by the manifold against the proximal and distal ridges, thereby forming a proximal channel between the proximal ridge and the stem, and a distal channel between the stem and the distal ridge, wherein the input stem is aligned with the input control aperture, wherein the elastomeric sheet contacts the stem when the elastomeric sheet is in a sealing configuration, thereby preventing fluid communication between the distal channel and the proximal channel, and wherein the elastomeric sheet is separated from the stem when a negative pressure is present in the control aperture, thereby allowing fluid communication between the distal channel and the proximal channel.

Example 20 is the valve assembly of example(s) 19, further comprising a pressure source in fluid communication with the control aperture.

Example 21 is the valve assembly of example(s) 20, wherein the pressure source is a positive pressure source.

Example 22 is the valve assembly of example(s) 19-21, further comprising a bolt, wherein the manifold comprises an aperture that receives the bolt, and wherein the bolt operates to compress the elastomeric sheet between the manifold and the proximal and distal ridges.

Example 23 is the valve assembly of example(s) 19-22, further comprising a snap clamp, wherein the snap clamp operates to compress the elastomeric sheet between the manifold and the proximal and distal ridges.

Example 24 is the valve assembly of example(s) 19-23, wherein the distal channel is in fluid communication with a channel of the microfluidic device.

Example 25 is a method of flowing a sample through a microfluidic device, comprising: flowing the sample to an input closed channel of the microfluidic device; flowing the sample from the input closed channel to a flow cell of the microfluidic device; and flowing the sample from the flow cell to an output closed channel of the microfluidic device, wherein the input closed channel is formed by a lamination film and an input recessed groove of a plastic substrate, wherein the flow cell is formed by a sensor and a recessed cavity of the plastic substrate, and wherein the output closed channel is formed by the lamination film and an output recessed groove of the plastic substrate.

Example 26 is the method of example(s) 25, wherein the input recessed groove and the output recessed groove are disposed at a first surface of the plastic substrate.

Example 27 is the method of example(s) 26, wherein the recessed cavity is disposed at a second surface of the plastic substrate, the first and second surfaces disposed on opposing sides of the plastic substrate.

Example 28 is the method of example(s) 25-27, wherein the sensor comprises an electronic circuit layer, and the electronic circuit layer faces toward an interior of the flow cell.

Example 29 is a method of controlling sample flow in a microfluidic device, comprising: flowing a sample into a proximal channel of the microfluidic device, the proximal channel formed between a proximal ridge and a stem, the proximal ridge and the stem extending from a floor of a raised structure; preventing flow of the sample from the proximal channel to a distal channel with a valve in a sealed configuration, the sealed configuration defined by an elastomeric sheet in contact with the stem, the distal channel formed between a distal ridge and the stem, the distal ridge extending from a floor of a raised structure, the elastomeric sheet disposed between a manifold and a raised structure, the raised structure comprising the floor, the proximal ridge, the distal ridge, and the stem; and allowing flow of the sample from the proximal channel to the distal channel with the valve in an open configuration, the open configuration defined by the elastomeric sheet separated from the stem.

Example 30 is the method of example(s) 29, wherein the manifold comprises a control aperture aligned with the stem, and wherein the open configuration is achieved by applying a negative pressure to the control aperture.

Example 31 is a microfluidic device comprising: a plastic substrate having a first surface and a second surface, the first and second surfaces disposed on opposite sides of the plastic substrate; a sensor having a first surface and a second surface, the first surface comprising an electronic circuit layer; an elastomer spacer; and a lamination film; wherein the first surface of the plastic substrate comprises an input recessed groove and an output recessed groove, wherein the second surface of the plastic substrate comprises a recessed cavity, wherein the lamination film is adhered to the first surface of the plastic substrate and covers the input recessed groove and the output recessed groove, such that an input closed channel is formed by the lamination film and the input recessed groove and an output closed channel is formed by the lamination film and the output recessed groove, wherein the sensor covers the recessed cavity, wherein the input closed channel is fluidly connected with the flow cell, wherein the output closed channel is fluidly connected with the flow cell, and wherein the elastomer spacer is disposed in the recessed cavity between the substrate and the sensor, such that the flow cell is formed by the first surface of the sensor, the recessed cavity, and the elastomer spacer.

Example 32 is the microfluidic device of example(s) 31, wherein the plastic substrate further comprises a snap click feature for applying compressive force between the plastic substrate and the sensor to compress the elastomeric spacer.

Example 33 is the microfluidic device of example(s) 31 or 32, further comprising an adhesive positionable between the elastomer spacer and the sensor for securing the elastomer spacer to the sensor.

What is claimed is:

1. A microfluidic device comprising:

a plastic substrate having a first surface and a second surface, the first and second surfaces disposed on opposite sides of the plastic substrate;

a sensor having a first surface and a second surface, the first surface comprising an electronic circuit layer; and a lamination film;

wherein the first surface of the plastic substrate comprises an input recessed groove and an output recessed groove, wherein the second surface of the plastic substrate comprises a recessed cavity, wherein the lamination film is adhered to the first surface of the plastic substrate and covers the input recessed groove and the output recessed groove, such that an input closed channel is formed by the lamination film and the input recessed groove and an output closed channel is formed by the lamination film and the output recessed groove, wherein the sensor covers the recessed cavity, such that a flow cell is formed by the first surface of the sensor and the recessed cavity, wherein the input closed channel is fluidly connected with the flow cell, and wherein the output closed channel is fluidly connected with the flow cell.

2. The microfluidic device of claim 1, further comprising a second lamination film, wherein the second surface of the plastic substrate comprises a second input recessed groove and a second output recessed groove, wherein the second lamination film is adhered to the second surface of the plastic substrate and covers the input recessed groove and the output recessed groove, such that a second input closed channel is formed by the second lamination film and the second input recessed groove and a second output closed channel is formed by the second lamination film and the second output recessed groove, and wherein the input closed channel is fluidly connected with the second input closed channel and the output closed channel is fluidly connected with the second output closed channel, such that the input closed channel provides fluid communication between the second input closed channel and the flow cell and the output closed channel provides fluid communication between the second output closed channel and the flow cell.

3. The microfluidic device of claim 2, wherein the input closed channel is fluidly connected with the second input closed channel by an input via positioned within the plastic substrate and the output closed channel is fluidly connected with the second output closed channel by an output via positioned within the plastic substrate.

4. The microfluidic device of claim 1, wherein the plastic substrate comprises an injection molded plastic.

5. The microfluidic device of claim 1, wherein the plastic substrate comprises a member selected from the group consisting of cyclic olefin polymer (COP), polymethyl methacrylate (PMMA), polycarbonate (PC), and polypropylene (PP).

6. The microfluidic device of claim 1, wherein the plastic substrate is optically transparent.

7. The microfluidic device of claim 1, further comprising a printed circuit board coupled with the second surface of the sensor.

8. The microfluidic device of claim 1, further comprising a wire bond, wherein the second surface of the plastic substrate further comprises a recess that receives the wire bond.

9. The microfluidic device of claim 1, further comprising a valve assembly that controls flow through the input closed channel and the output closed channel, the valve assembly comprising:

a manifold comprising an input control aperture and an output control aperture;

an elastomeric sheet disposed between the manifold and an upper surface of the plastic substrate; and a raised structure extending from the upper surface of the plastic substrate toward the elastomeric sheet, the raised structure comprising an input proximal ridge, an input distal ridge, an input stem positioned between the input proximal ridge and the input distal ridge, an output proximal ridge, an output distal ridge, and an output stem positioned between the output proximal ridge and the output distal ridge, wherein the elastomeric sheet is compressed by the manifold against the input proximal and distal ridges and the output proximal and distal ridges, thereby forming an input proximal channel between the input proximal ridge and the input stem, an input distal channel between the input stem and the input distal ridge, an output proximal channel between the output proximal ridge and the output stem, and an output distal channel between the output stem and the output distal ridge, wherein the input stem is aligned with the input control aperture and the output stem is aligned with the output control aperture, wherein elastomeric sheet contacts the input and output stems when the elastomeric sheet is in a default sealing configuration, thereby preventing fluid communication between the input distal channel and the input proximal channel and between the output distal channel and the output proximal channel, wherein the contact sheets is separated from the input stem when a negative pressure is present in the input control aperture, thereby allowing fluid communication between the input distal channel and the input proximal channel, and wherein the contact sheets is separated from the output stem when a negative pressure is present in the output control aperture, thereby allowing fluid communication between the output distal channel and the output proximal channel.

10. The microfluidic device of claim 1, further comprising a set of secondary channel groups each comprising a secondary channel fluidically coupling a reagent inlet to a valve, wherein each valve is fluidically coupled to the input closed channel and actuatable between an open state permitting fluid flow through the valve and a closed state restricting fluid flow through the valve.

11. The microfluidic device of claim 10, wherein at least one of the secondary channel groups of the set of secondary channel groups comprises an additional secondary channel fluidically coupling an additional reagent inlet to the valve.

12. The microfluidic device of claim 10, wherein each of the valves are arranged circumferentially around a circular-shaped portion of a common channel fluidically coupled to the input closed channel.

13. The microfluidic device of claim 10, wherein the set of secondary channel groups comprises a first subset of secondary channel groups and a second subset of secondary channel groups, wherein the first subset is distinct from the second subset, wherein the first subset of secondary channel groups is fluidically coupled to a common channel through a first branch channel, wherein the second subset of secondary channel groups is fluidically coupled to the common channel through a second branch channel, and wherein the common channel is fluidically coupled to the input closed channel.

14. The microfluidic device of claim 1, further comprising a membrane valve that controls fluid flow through the input closed channel, the membrane valve comprising:

an aperture in a surface of the plastic substrate selected from the group consisting of the first surface and the second surface, wherein a flexible membrane is secured to the surface over the aperture;

a valve seat positioned within the aperture;

a first channel of the plastic substrate and a second channel of the plastic substrate fluidically coupled through the aperture by a passage defined at least in part by a space between the flexible membrane and the valve seat, wherein the flexible membrane is compressible against the valve seat to seal the passage and restrict fluid flow between the first channel and the second channel, and wherein one of the first channel and the second channel is fluidically coupled to the input closed channel.

15. The microfluidic device of claim 1, wherein the plastic substrate is secured to the sensor by an adhesive.

16. The microfluidic device of claim 1, wherein the plastic substrate further comprises an elastomeric spacer positioned to engage the sensor covering the recessed cavity such that the flow cell is further formed by the elastomeric spacer.

17. The microfluidic device of claim 1, wherein the sensor is supported on a substrate, and wherein the flow cell is further formed by the substrate such that the entire first surface of the sensor is disposed within a boundary of the flow cell.

18. The microfluidic device of claim 1, further comprising an additional sensor, wherein recessed cavity is further covered by the additional sensor such that the flow cell is further formed by a first surface of the additional sensor.

19. A method of flowing a sample through the microfluidic device of claim 1, comprising:

flowing the sample to the input closed channel of the microfluidic device;

flowing the sample from the input closed channel to the flow cell of the microfluidic device; and flowing the sample from the flow cell to the output closed channel of the microfluidic device.

20. The method of claim 19, wherein the input recessed groove and the output recessed groove are disposed at a first surface of the plastic substrate.

21. The method of claim 20, wherein the recessed cavity is disposed at a second surface of the plastic substrate, the first and second surfaces disposed on opposing sides of the plastic substrate.

22. The method of claim 19, wherein the sensor comprises an electronic circuit layer, and the electronic circuit layer faces toward an interior of the flow cell.

23. A microfluidic device comprising:

a plastic substrate having a first surface and a second surface, the first and second surfaces disposed on opposite sides of the plastic substrate;

a sensor having a first surface and a second surface, the first surface comprising an electronic circuit layer;

an elastomer spacer; and a lamination film;

wherein the first surface of the plastic substrate comprises an input recessed groove and an output recessed groove, wherein the second surface of the plastic substrate comprises a recessed cavity, wherein the lamination film is adhered to the first surface of the plastic substrate and covers the input recessed groove and the output recessed groove, such that an input closed channel is formed by the lamination film and the input recessed groove and an output closed channel is formed by the lamination film and the output recessed groove, wherein the sensor covers the recessed cavity, wherein the input closed channel is fluidly connected with a flow cell, wherein the output closed channel is fluidly connected with the flow cell, and wherein the elastomer spacer is disposed in the recessed cavity between the substrate and the sensor, such that the flow cell is formed by the first surface of the sensor, the recessed cavity, and the elastomer spacer.

24. The microfluidic device of claim 23, wherein the plastic substrate further comprises a snap click feature for applying compressive force between the plastic substrate and the sensor to compress the elastomer spacer.

25. The microfluidic device of claim 23, further comprising an adhesive positionable between the elastomer spacer and the sensor for securing the elastomer spacer to the sensor.

* * * * *